US009847063B2

(12) United States Patent
Park et al.

(10) Patent No.: US 9,847,063 B2
(45) Date of Patent: Dec. 19, 2017

(54) LIQUID CRYSTAL DISPLAY AND DRIVING METHOD THEREOF

(71) Applicant: SAMSUNG DISPLAY CO., LTD., Yongin, Gyeonggi-do (KR)

(72) Inventors: Su Hyeong Park, Gyeongju-si (KR); Ung Gyu Min, Seoul (KR); Ji Myoung Seo, Suwon-si (KR); Cheol Woo Park, Suwon-si (KR); Ho Yong Jung, Seongnam-si (KR)

(73) Assignee: Samsung Display Co., Ltd., Yongin, Gyeonggi-do (KR)

( * ) Notice: Subject to any disclaimer, the term of this patent is extended or adjusted under 35 U.S.C. 154(b) by 96 days.

(21) Appl. No.: 14/523,590

(22) Filed: Oct. 24, 2014

(65) Prior Publication Data

US 2015/0123961 A1 May 7, 2015

(30) Foreign Application Priority Data

Nov. 4, 2013 (KR) ..... 10-2013-0132960

(51) Int. Cl.
*G09G 5/00* (2006.01)
*G09G 3/36* (2006.01)

(52) U.S. Cl.
CPC ..... *G09G 3/3614* (2013.01); *G09G 3/3688* (2013.01); *G09G 2310/0248* (2013.01); *G09G 2330/021* (2013.01)

(58) Field of Classification Search
CPC .. G09G 3/3614; G09G 3/3696; G09G 3/3688; G09G 2300/0478; G09G 2310/0248; G09G 2330/021
USPC ..... 345/212, 96
See application file for complete search history.

(56) References Cited

U.S. PATENT DOCUMENTS

| | | | |
|---|---|---|---|
| 6,549,186 | B1 | 4/2003 | Kwon |
| 6,573,881 | B1 | 6/2003 | Kwon |
| 7,518,588 | B2 | 4/2009 | Lin |
| 7,663,594 | B2 | 2/2010 | Do et al. |
| 7,800,601 | B2 | 9/2010 | Miura |
| 7,928,949 | B2 | 4/2011 | Kim et al. |
| 7,956,833 | B2 | 6/2011 | Ito et al. |

(Continued)

FOREIGN PATENT DOCUMENTS

| | | | |
|---|---|---|---|
| JP | 2012-058692 | A | 3/2012 |
| KR | 10-1070555 | B1 | 9/2011 |

*Primary Examiner* — Towfiq Elahi
(74) *Attorney, Agent, or Firm* — Knobbe, Martens, Olson & Bear LLP

(57) ABSTRACT

A liquid crystal display includes: a display panel; a signal controller configured to receive an input image signal and an input control signal, output an output image signal and an output control signal, and determine a charge sharing between two or more data lines having voltages in the same polarity; and a data driver configured to convert, based on the output control signal, the image signal into data voltages to be supplied to the data lines connected to the pixels, the data voltages having positive levels and negative levels. The data driver is further configured to perform a first charge sharing by short-circuiting first and second data lines that are adjacent to each other, and a second charge sharing by short-circuiting third and fourth data lines having data voltages in the same polarity, wherein the first charge sharing and the second charge sharing may not temporally overlap with each other.

19 Claims, 19 Drawing Sheets

(56) References Cited

U.S. PATENT DOCUMENTS

| | | | | |
|---|---|---|---|---|
| 7,956,854 | B2 | 6/2011 | Hashimoto | |
| 8,022,917 | B2 | 9/2011 | Lin et al. | |
| 8,089,437 | B2 | 1/2012 | Maekawa | |
| 8,294,509 | B2 | 10/2012 | Pan et al. | |
| 8,384,646 | B2 | 2/2013 | Park et al. | |
| 2008/0150852 | A1 | 6/2008 | Edwards | |
| 2008/0278467 | A1* | 11/2008 | Hwang | G09G 3/3648 345/205 |
| 2009/0201283 | A1 | 8/2009 | Inokuchi et al. | |
| 2011/0248985 | A1* | 10/2011 | Lin | G09G 3/3614 345/214 |
| 2011/0310080 | A1* | 12/2011 | Tonomura | G09G 3/3688 345/211 |
| 2011/0316823 | A1* | 12/2011 | Otani | G09G 3/3688 345/204 |
| 2012/0092322 | A1* | 4/2012 | Enjou | G09G 3/3688 345/211 |
| 2013/0027283 | A1 | 1/2013 | Cristaudo et al. | |

* cited by examiner

LIQUID CRYSTAL DISPLAY AND DRIVING METHOD THEREOF

CROSS-REFERENCE TO RELATED APPLICATION

This application claims priority to and the benefit of Korean Patent Application No. 10-2013-0132960 filed in the Korean Intellectual Property Office on Nov. 4, 2013, the entire contents of which are incorporated herein by reference.

BACKGROUND

Field

The disclosed technology generally relates to a liquid crystal display and a driving method thereof.

Description of the Related Art

A liquid crystal display, which is one of the most common types of flat panel displays currently in use, includes two sheets of panels with field generating electrodes such as a pixel electrode and a common electrode, and a liquid crystal layer interposed therebetween. The liquid crystal display generates an electric field in the liquid crystal layer by applying a voltage to the field generating electrodes, and determines the direction of liquid crystal molecules of the liquid crystal layer by the generated electric field, thus controlling polarization of incident light so as to display images.

The liquid crystal display performs inversion driving, which changes the direction of an electric field applied to the liquid crystal layer to prevent the liquid crystal layer from deteriorating. For the inversion driving, since the polarity of a data voltage applied to the data line is continuously changed at a predetermined interval, there is a disadvantage in that power consumption is increased.

The above information disclosed in this Background section is only for enhancement of understanding of the background of the invention and does not constitute an admission of prior art.

SUMMARY

Embodiments of the present disclosure provide a liquid crystal display and a driving method thereof in which power consumption is not increased despite the use of inversion driving.

An exemplary embodiment of the present invention provides a liquid crystal display including: a display panel comprising a plurality of pixels and a plurality of data lines connected to the plurality of pixels; a signal controller configured to receive an input image signal and an input control signal and output an output image signal and an output control signal, the signal controller further configured to determine a charge sharing between two or more data lines having voltages in the same polarity; and a data driver configured to convert, based on the output control signal, the image signal into data voltages to be supplied to the plurality of data lines connected to the plurality of pixels, the data voltages having a plurality of positive levels and a plurality of negative levels. The data driver is further configured to perform a first charge sharing by short-circuiting first and second data lines that are adjacent to each other, the first data line having a positive voltage and the second data line having a negative voltage in a first time frame and the first data line having a negative voltage and the second data line having a positive voltage in a second time frame subsequent to the first time frame, and a second charge sharing by short-circuiting third and fourth data lines having data voltages in the same polarity, when determined that the third data line has a first voltage level of a particular polarity in a first sub-period and the third data line has a second voltage level of the particular polarity a second sub-period subsequent to the first time period. The first charge sharing and the second charge sharing may not temporally overlap with each other.

The pixels adjacent in an extending direction of the data lines among the plurality of pixels may be connected to the adjacent data lines having different polarities.

The output control signal may include an inversion signal for inverting the polarities of the data voltages for each frame, each frame comprising a plurality of sub-periods, and the first charge sharing may be performed during the first sub-period after the polarities of the data voltages are inverted by the inversion signal.

During the second charge sharing, the data driver may connect the data lines representing the same polarity and an additional capacitor.

The second charge sharing may comprise a positive charge sharing stage in which the data lines to which positive data voltages are applied are short-circuited, and a negative charge sharing stage in which the data lines to which negative data voltages are applied are short-circuited, and the positive and negative charge sharing stages may either be simultaneously performed or may not temporally overlap with each other.

The signal controller may include a charge sharing determining unit configured to determine whether the second charge sharing is to be performed, and the data driver may include a charge sharing controller configured to output a charge sharing control signal for controlling the first charge sharing and the second charge sharing, and a charge sharing operation unit configured to operate according to the charge sharing control signal output by the charge sharing controller.

The charge sharing operation unit of the data driver may include a first charge sharing operation unit configured to perform the first charge sharing and a second charge sharing operation unit configured to perform the second charge sharing, and image data transferred from the signal controller to the data driver may be output to the data lines sequentially through: a first MUX configured to select a path for converting the image data to a data voltage of a suitable polarity; a Digital-toAnalog Converter (DAC) configured to convert the image data into the data voltage of the suitable polarity; the second charge sharing operation unit configured to perform the second charge sharing; a second MUX configured to select a path to the data line to which the data voltage is to be applied; and a first charge sharing operation unit configured to perform the first charge sharing.

The image data transferred from the signal controller to the data driver may be output to the data lines sequentially through: a first MUX configured to select a path for converting the image data to a data voltage of a suitable polarity; a DAC configured to convert the image data into the data voltage of the suitable polarity; a second MUX configured to select a path to the data line to which the data voltage is to be applied; and the charge sharing operation unit configured to perform the first charge sharing and the second charge sharing.

The charge sharing operation unit of the data driver may include a first charge sharing operation unit configured to perform the first charge sharing, a second charge sharing operation unit configured to perform the second charge sharing, and an independent charge sharing operation unit configured to determine for each data line whether the second charge sharing is to be performed and to output a signal indicating whether the second charge sharing is to be performed, and the image data transferred from the signal controller to the data driver may be output to the data lines sequentially through: a first MUX configured to select a path for converting the image signal to a data voltage of a suitable polarity; a DAC configured to convert the image data into the data voltage of the suitable polarity; the second charge sharing operation unit configured to perform the second charge sharing based on the signal output by the independent charge sharing operation unit; a second MUX configured to select a path to the data line to which the data voltage is to be applied; and a first charge sharing operation unit configured to perform the first charge sharing.

The independent charge sharing operation unit may output a signal indicating that the second charge sharing is to be performed, only when a difference between a data voltage in a previous row of the plurality of pixels and a data voltage in a present row of the plurality of pixels among the data voltages applied to the corresponding data lines is greater than or equal to a threshold voltage The independent charge sharing operation unit outputs a signal indicating that the second charge sharing is to be performed, only when the most significant bit (MSB) of the image data applied to a previous sub-period and the MSB of the image data applied to a subsequent sub-period are different from each other. The charge sharing operation unit of the data driver may include a first charge sharing operation unit configured to perform the first charge sharing, a second charge sharing operation unit configured to perform the second charge sharing, and an independent charge sharing operation unit configured to determine for each data line whether the second charge sharing is to be performed and to output a signal indicating whether the second charge sharing is to be performed, and the image data transferred from the signal controller to the data driver may be output to the data lines sequentially through: a first MUX configured to select a path for converting the image data to a data voltage of a suitable polarity; a DAC configured to convert the image data into the data voltage of the suitable polarity; a second MUX configured to select a path to the data line to which the data voltage is to be applied; a first charge sharing operation unit configured to perform the first charge sharing; and a second charge sharing operation unit configured to perform the second charge sharing based on the signal output by the independent charge sharing operation unit.

The independent charge sharing operation unit may output a signal indicating that the second charge sharing is to be performed, only when a difference between a data voltage in a previous row of the plurality of pixels and a data voltage in a present row of the plurality of pixels among the data voltages applied to the corresponding data lines is greater than or equal to a threshold voltage. The independent charge sharing operation unit may output a signal indicating that the second charge sharing is to be performed, only when the MSB of the image data applied to a previous sub-period and the MSB of the image data applied to a subsequent sub-period are different from each other. The data driver may further include a second charge sharing determining unit configured to determine whether the second charge sharing is to be performed and to output a signal indicating whether the second charge sharing is to be performed, and the signal output by the second charge sharing determining unit may be input to the charge sharing controller to operate the charge sharing operation unit. The second charge sharing determining unit may include: a charge sharing latch configured to store input image data; an XOR unit configured to perform an XOR operation on the MSB of the image data in the current sub-period and the MSB of the image data in the sub-period immediately preceding the current sub-period stored in the charge sharing latch; an OR unit configured to perform an OR operation on the output of the XOR unit and a signal indicating whether the second charge sharing is to be performed in all the data lines or to be performed selectively; and an AND unit configured to perform an AND operation on the output of the OR unit and a signal indicating whether the second charge sharing is to be performed.

Another embodiment of the present invention provides a driving method of a liquid crystal display including: a display panel comprising a plurality of pixels and a plurality of data lines connected to the plurality of pixels; a signal controller configured to receive an input image signal and an input control signal and output an image signal and an output control signal, the signal controller further configured to determine a charge sharing between two or more data lines having voltages ion the same polarity; and a data driver configured to convert, based on the output control signal, the image signal into data voltages to be supplied to the plurality of pixels through the data lines, the driving method, comprising: short-circuiting first and second data lines that are adjacent to each other, the the first data line having a positive voltage and the second data line having a negative voltage in a first time frame and the first data line having a negative voltage and the second data line having a positive voltage in a second time frame subsequent to the first time frame, in a first charge sharing step; and short-circuiting third and fourth data lines having data voltages in the same polarity, when determined that the third data line has a first voltage level of a particular polarity in a first sub-period and the third data line has a second voltage level of the particular polarity a second sub-period subsequent to the first time period, in a second charge sharing step, wherein the first charge sharing step and the second charge sharing step do not temporally overlap with each other.

The driving method may further include transferring, by the signal controller, an inversion signal to the data driver for inverting the polarities of the data voltages for each frame, each frame comprising a plurality of sub-periods, wherein the first charge sharing step is performed during the first sub-period after the polarities of the data voltages are inverted by the inversion signal.

The driving method may further include connecting together the data lines representing the same polarity and an additional capacitor in the second charge sharing step. The driving method may further include: short-circuiting the data lines to which positive data voltages are applied in a positive charge sharing stage of the second charge sharing step; and short-circuiting the data lines to which negative data voltages are applied in a negative charge sharing stage of the second charge sharing step. The positive charge sharing stage and the negative charge sharing stage may either be simultaneously performed or may not temporally overlap with each other.

As such, an increase of power consumption generated when the data voltages are changed is reduced by connecting data lines to which data voltages having different polarities are applied and connecting data lines to which data voltages having the same polarity are applied when a predetermined condition is satisfied, thereby decreasing power consumption.

DETAILED DESCRIPTION OF EMBODIMENTS

Figure 1:
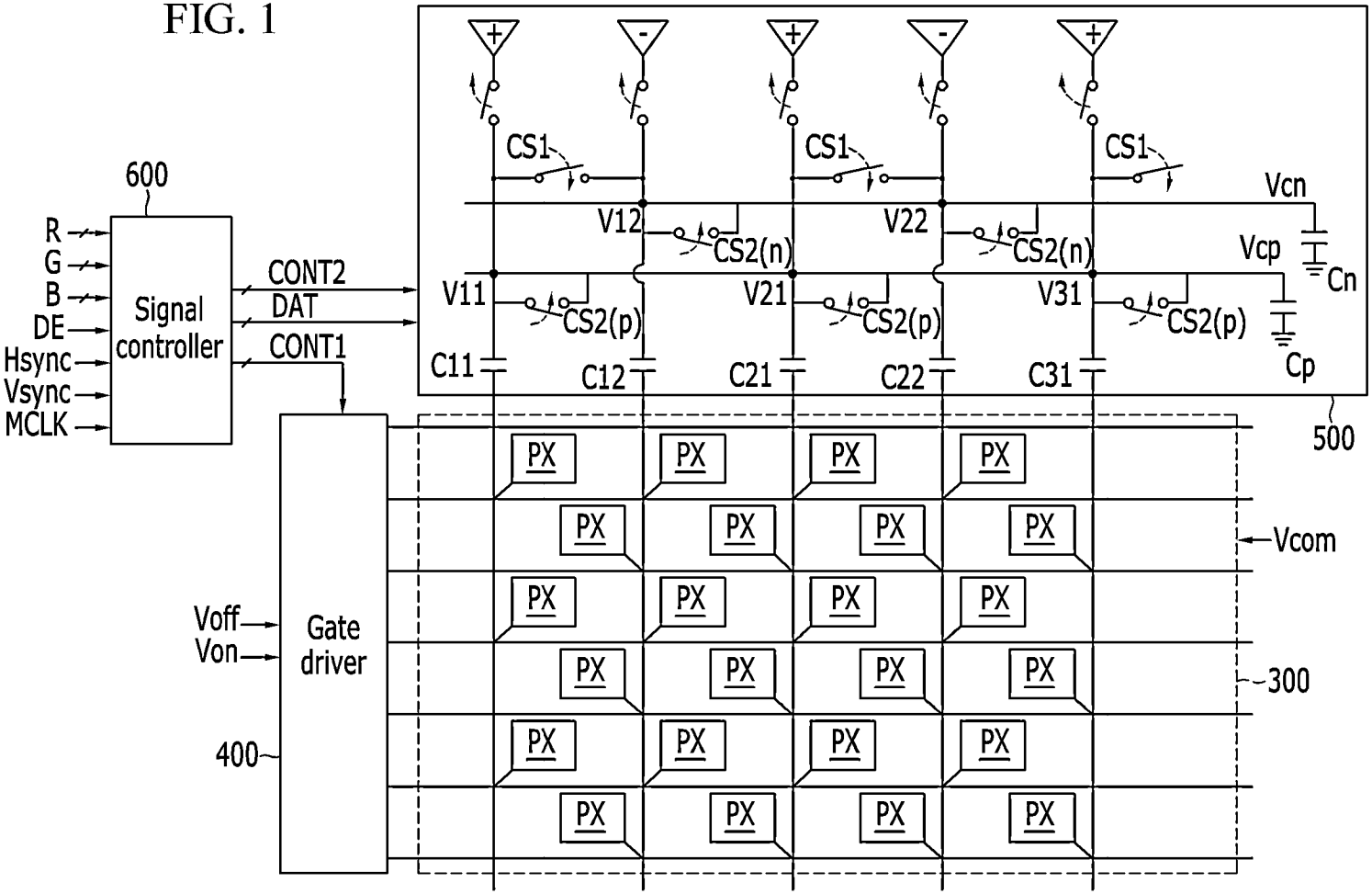
FIG. 1 is a block diagram of a liquid crystal display according to an embodiment of the present invention.

The present invention will be described more fully hereinafter with reference to the accompanying drawings, in which embodiments of the invention are shown. As those skilled in the art would realize, the described embodiments may be modified in various different ways, all without departing from the spirit or scope of the present invention.

In the drawings, the thickness of layers, films, panels, regions, etc., are exaggerated for clarity. Like reference numerals designate like elements throughout the specification. It will be understood that when an element such as a layer, film, region, or substrate is referred to as being "on" another element, it can be directly on the other element or intervening elements may also be present. In contrast, when an element is referred to as being "directly on" another element, there are no intervening elements present.

Hereinafter, a liquid crystal display according to an embodiment will be described in detail with reference to FIG. 1.

FIG. 1 is a block diagram of a liquid crystal display according to an embodiment.

Referring to FIG. 1, a liquid crystal panel 300 includes a plurality of pixels PX that are arranged substantially in a matrix form. The plurality of pixels PX are connected to a plurality of signal lines. The signal lines include a plurality of gate lines transferring gate signals (referred to as "scanning signals"), and a plurality of data lines transferring data voltages.

The pixels PX that are vertically adjacent to each other (e.g., in the same column in FIG. 1) are connected to different data lines, and the pixels PX that are horizontally adjacent to each other (e.g., in the same row in FIG. 1) are connected to data lines positioned at the same side. That is, according to the embodiment of FIG. 1, the pixels PX disposed along the same column are alternately connected to different data lines among data lines that are disposed at left and right sides (e.g., the first pixel may be connected to the data line on the left side, the second pixel may be connected to the data line on the right side, the third pixel may be connected to the data line on the left side, and so on). Meanwhile, the pixels PX disposed along the same row are connected to the data lines positioned at the same side among the data lines that are disposed at left and right sides. In the embodiment of FIG. 1, all of the pixels PX connected to the first row are connected to the data lines positioned at the left side with respect to the respective pixels (e.g., when viewed as shown in FIG. 1).

The liquid crystal panel 300 including the pixels PX connected as illustrated in FIG. 1 may, for example, have an apparent inversion of a dot inversion even if the data voltages having the same polarity are applied to a single data line for one frame, a characteristic of a column inversion. As such, the configuration illustrated in FIG. 1 may reduce the power consumed in the display panel 300.

The gate driver 400 is connected to gate lines of the liquid crystal panel 300 to apply gate signals including a combination of a gate-on voltage Von and a gate-off voltage Voff to the gate lines. When the gate-on voltage is applied, a switching element such as a thin film transistor positioned at the corresponding pixel PX is turned on.

The data driver 500 is connected to the data lines of the liquid crystal panel 300, and converts data (which is a digital signal) into a data voltage (which is an analog voltage), and applies the data voltage to the data line. A gray voltage generator (not illustrated) may be further included for converting the data into the data voltage, and such gray voltage generator may be internal to the data driver 500 or external to the data driver 500. The data driver 500 selects a voltage corresponding to the data among the voltages generated from the gray voltage generator and converts the selected voltage to generate data voltage. The gray voltage generator generates two sets of gray voltages for inversion driving. One set of the two sets may have a positive value with respect to a common voltage Vcom, and the other set may have a negative value.

The data driver 500 according to the embodiment includes a plurality of switches for charge sharing. The charge sharing included in the embodiment can be largely classified into two types. The charge sharing includes a first charge sharing (hereinafter, referred to as 'CS1') in which a charge is shared by short-circuiting data lines representing a positive voltage and a negative voltage, and a second charge sharing (hereinafter, referred to as 'CS2') in which a charge is shared by short-circuiting the positive voltages together and short-circuiting the negative voltages together. As illustrated in FIG. 1, the data driver 500 includes a switch for the first charge sharing, a switch for the second charge sharing, and a switch disconnecting a data line from a data voltage applying source. The switch disconnecting the data line from the data voltage applying source is positioned closer to the data voltage applying source than the switch for the first charge sharing. Such configuration may separate the data voltage applying source during the first charge sharing and connect only adjacent data lines to each other. The switch for the first charge sharing is operated (e.g., closed) by a CS1 signal, and when the switch for the first charge sharing is closed, the switch disconnecting the data voltage applying source and the data line may be opened. Further, there are two kinds of switches for the second charge sharing due to different polarities, and each of the two kinds of switches performs a closing operation by a CS2($p$) or CS2($n$) signal. When the switches for the second charge sharing are closed, the switch disconnecting the data voltage applying source and the data line may perform an opening operation by the CS2($p$) and CS2($n$) signals.

First, the first charge sharing CS1 short-circuits two adjacent data lines, to which a positive voltage and a negative voltage are respectively applied, and as a result, the two data lines easily have an intermediate voltage. The intermediate voltage is a voltage based on a common voltage, and has a value that is varied according to the charge applied to each wiring. Such charge sharing allows the voltages of the data lines to reach the intermediate voltage without a separate driving, and as a result, the data lines may reach the respective opposite polarities more easily at the next frame. In this case, additional power is not consumed. Thus, in the embodiment of FIG. 1, two adjacent data lines are short-circuited by the CS1 signal (and disconnected from the data voltage applying source) to share the charge between the two adjacent data lines and reach the intermediate voltage.

Meanwhile, the second charge sharing CS2 short-circuits a plurality of data lines to which data voltages having the same polarity are applied. Thus, in the embodiment of FIG. 1, the two adjacent data lines may be short-circuited together (e.g., by switches CS1), and all the data lines to which the voltages having the same polarity are applied may also be short-circuited together (e.g., by switches CS2). In the embodiment of FIG. 1, the second charge sharing for the positive data voltage is represented as the CS2(*p*), and the second charge sharing for the negative data voltage is represented as the CS2(*n*). Thus, in the embodiment of FIG. 1, all the data lines to which the positive data voltages are applied are short-circuited by the CS2(*p*) signal, and all the data lines to which the negative data voltages are applied are short-circuited by the CS2(*n*) signal. The CS2(*p*) signal and the CS2(*n*) signal may be applied simultaneously or separately. The embodiment of FIG. 1 illustrates structure, in which all the data lines to which the same data voltage is applied are short-circuited together during the second charge sharing CS2, and disconnected from the data voltage applying source, and as a result, the data lines having the same polarity share the charge amongst themselves and reach the intermediate voltage.

In FIG. 1, a plurality of capacitors C11, C12, C21, C22, and C31 in the data driver 500 may be actually formed capacitors. Alternatively, the plurality of capacitors may be a capacitance of each data line illustrated in FIG. 1. When the CS2(*p*) signal or the CS2(*n*) signal is applied, a capacitance of each data line and additional capacitors Cp and Cn connected thereto are connected to each other in parallel.

That is, when the data lines to which the positive data voltages are applied are connected to each other by the CS2(*p*) signal, a first additional capacitor Cp is parallelly connected to the capacitance of each data line in parallel to share the charge. As a result, voltages of each data line and one end of the first capacitor Cp become Vcp. In this case, the Vcp voltage is changed according to all the connected capacitances, and has a positive value.

Meanwhile, when the data lines to which the negative data voltages are applied are connected to each other by the CS2(*n*) signal, a second additional capacitor Cn is parallelly connected to the capacitance of each data line to share the charge. As a result, voltages of each data line and one end of the second capacitor Cn become Vcn. In this case, the Vcn voltage is changed according to all the connected capacitances, and has a negative value.

In FIG. 1, the first additional capacitor Cp and the second additional capacitor Cn are positioned inside the data driver 500, but according to another embodiment, the capacitors Cp and Cn may be positioned outside the data driver 500.

Since the polarity of the data voltage applied to each data line is changed when one frame elapses (e.g., every frame), the above polarities would be the opposite for the subsequent frame.

Meanwhile, in the embodiment of FIG. 1, the CS1 signal and the CS2(*p*)/CS2(*n*) signal may be provided from the signal controller 600, and may not necessarily be all applied together.

The signal controller 600 controls the gate driver 400 and the data driver 500.

The signal controller 600 receives input image signals R, G, and B and an input control signal for controlling display of the input image signals R, G, and B from an external graphic controller (not illustrated). The input image signals R, G, and B store luminance information of each pixel PX, and luminance has a predetermined number of grays (e.g., gradations), for example, 1024 ($=2^{10}$), 256 ($=2^{8}$), or 64 ($=2^{6}$) grays. An example of the input control signal includes a vertical synchronization signal Vsync, a horizontal synchronization signal Hsync, a main clock MCLK, a data enable signal DE, and the like.

The signal controller 600 appropriately processes the input image signals R, G, and B in accordance with operation conditions of the liquid crystal panel 300 and the data driver 500 based on the input image signals R, G, and B and the input control signal. The signal controller 600 generates gate control signal CONT1 and a data control signal CONT2, a backlight control signal (not illustrated), and the like, and then transmits the gate control signal CONT1 to the gate driver 400, and outputs the data control signal CONT2 and the processed image signal DAT to the data driver 500. The backlight control signal is output to a backlight unit (not illustrated). The output image signal DAT may be a digital signal comprising a predetermined number of values (or grays).

The gate control signal CONT1 includes a scanning start signal STV instructing scanning start and a pair of clock signals controlling an output period of the gate-on voltage Von. The gate control signal CONT1 may further include an output enable signal OE limiting a duration time of the gate-on voltage Von.

The data control signal CONT2 includes a horizontal synchronization start signal STH informing transmission start of the image data for pixels PX in one row, a load signal LOAD instructing a data signal to be applied to the data lines D1-Dm, and a data clock signal HCLK. The data control signal CONT2 may further include an inversion signal POL inverting a voltage polarity of the data signal with respect to the common voltage Vcom (hereinafter, referred to simply as a "polarity of the data signal").

According to the data control signal CONT2 from the signal controller 600, the data driver 500 receives the digital image signal DAT for pixels PX in one row and selects a gray voltage corresponding to each digital image signal DAT to convert the digital image signal DAT into an analog data signal. The data driver 500 then applies the converted analog data signal to the corresponding data lines D1-Dm. The number of gray voltages generated by the gray voltage generator is the same as the number of grays represented by the digital image signal DAT.

The gate driver 400 applies the gate-on voltage Von to the gate lines G1-Gn according to the gate control signal CONT1 from the signal controller 600 to turn on the switching elements Q connected to the gate lines G1-Gn. Then, the data signals applied to the data lines D1-Dm are applied to the corresponding pixels PX through the turned-on switching elements Q.

Each of the driving devices 400, 500, and 600 may be directly installed on the liquid crystal panel 300 in at least one IC chip form, or installed on a flexible printed circuit film (not illustrated) to be attached to the liquid crystal panel 300 in a tape carrier package (TCP) form. Alternatively, the driving devices 400, 500, and 600 may be integrated on the liquid crystal panel 300 together with the signal lines, the thin film transistor switching element Q, and the like. Further, the driving devices 400, 500, and 600 may be all integrated by a single chip, and in such a case, at least one of the driving devices or at least one circuit element configuring the driving devices may be positioned outside the single chip.

When one frame ends, the next frame starts, and the state of the inversion signal POL applied to the data driver 500 is controlled so that the polarity of the data signal applied to each pixel PX is opposite to the polarity in the previous frame ("frame inversion"). In this case, the polarity of the voltage applied to a single data line within a single frame is not changed and thus the data voltage is applied to the data line like a column inversion, but the apparent inversion is the same as a dot inversion due to a pixel connection structure.

Hereinafter, a method of performing the charge sharing in the liquid crystal display will be described through a waveform diagram.

Figure 2:
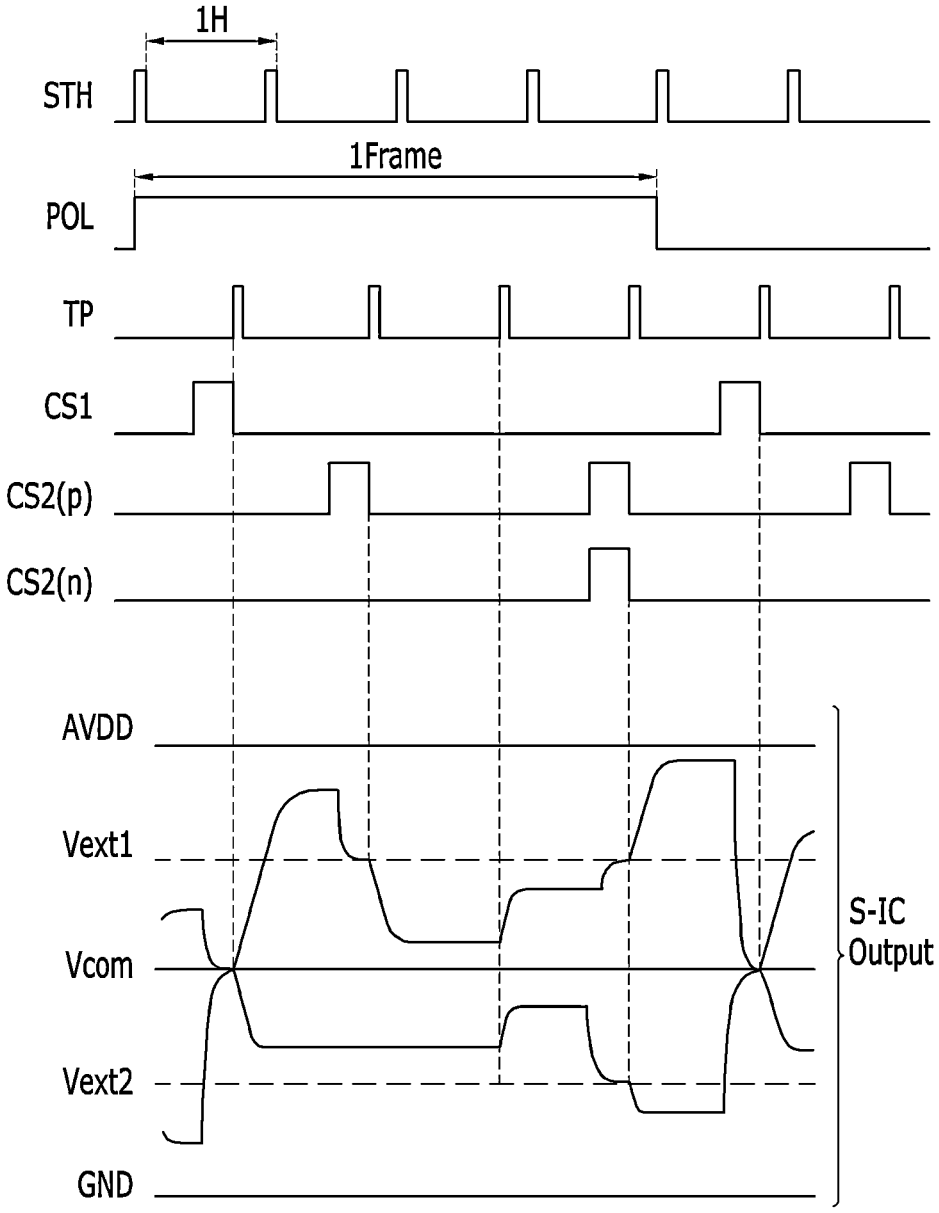
FIG. 2 is a waveform diagram of the liquid crystal display according to the embodiment of the present invention.

FIG. 2 is a waveform diagram of the liquid crystal display according to the embodiment.

The liquid crystal display according to the embodiment changes the polarity of the data voltage applied to the data line for every frame. Therefore, one half of the period of the inversion signal POL corresponds to one frame.

In the embodiment of FIG. 2, 1H represents the time it takes for one gate-on voltage to be applied by the horizontal synchronizing signal STH. During the 1H period, the gate-on voltage is applied to the gate lines in one row, and the data voltage is applied to the pixels of the corresponding row.

When the inversion signal POL is inverted, the CS1 signal is converted to high in the inverted 1H period. As a result, the first charge sharing is performed, and thus the data lines having a positive voltage and a negative voltage are short-circuited together. In this case, the switch disconnecting the data voltage applying source and the data line is opened. According to an embodiment, two adjacent data lines are short-circuited. In another embodiment, all the data lines are short-circuited. Since the inversion signal POL is inverted for every frame, 1H when the CS1 signal is applied may be a first 1H of one frame. At the first 1H, since the second charge sharing is not performed, the CS2($p$) and CS2($n$) signals are not generated. Since charges are shared between the positive voltages or the negative voltages, the second charge sharing is different from the first charge sharing which shares the positive voltage and the negative voltage. Thus, the first charge sharing and the second charge sharing are separately performed.

The second charge sharing is selectively performed only when a predetermined condition is satisfied for a 1H period (except for the first 1H) in one frame. That is, the first charge sharing and the second charge sharing are performed for different 1H periods and thus do not overlap (e.g., temporally) with each other. According to an embodiment, in the second charge sharing, the data lines having the same polarity may be entirely connected together. In another embodiment, in the second charge sharing, the data lines connected to one data driving IC may be entirely connected together.

In the second charge sharing, since power consumption is large during transitioning to a data voltage having a high gray or a data voltage having a low gray even in the data lines having the same polarity, by first moving to a voltage based on a data voltage of an intermediate gray through the second charge sharing, and then moving to a target data voltage, the data driver 500 reduces the change in voltage to be driven by consuming additional power.

However, the voltage applied to each data line varies for each displayed image, and when the second charge sharing is actually performed, the change width of the voltage moved by the data driver 500 may be increased by the second charge sharing. Therefore, the second charge sharing may be selectively performed.

Whether the second charge sharing is performed may be determined by the signal controller 600 or the data driver 500, and a determining method may vary. As an example of the determining method, whether the second charge sharing is performed may be determined by determining whether a total voltage applied to the connected data lines (a representative value may be used according to an embodiment) passes the intermediate gray value (128 gray value in the case of 256 gray). That is, in the case of passing the intermediate gray value, a voltage change exists in a previous 1H and a present 1H, and since the voltage applied to the data line first reaches the intermediate voltage before transitioning to the final voltage through the second charge sharing, using the second charge sharing is advantageous for power consumption.

The voltage change of the output terminal (e.g., data lines) of the data driver 500 (illustrated as S-IC in FIG. 2) according to an embodiment will be described with reference to FIG. 2.

First, when the inversion signal POL is applied, the CS1 signal is applied at the first 1H (indicated by the first broken line shown in FIG. 2). As a result, the data line having the charge of the positive voltage and the data line having the charge of the negative voltage are short-circuited together to perform the first charge sharing. As a result, the data lines have a common voltage Vcom or a voltage corresponding to the common voltage Vcom.

Thereafter, before the inversion signal POL is changed, when the same voltage is applied to the data lines and the data voltage in which the previous 1H and the present 1H pass the intermediate gray is applied, the second charge sharing is performed (indicated by the second broken line shown in FIG. 2). When the second charge sharing is performed, voltage values Vcp and Vcn after the second charge sharing may vary based on the charge of the data lines having the same polarity and performing the second charge sharing. However, since a portion of the voltage change is achieved by the second charge sharing, although the data driver 500 consumes power, a change in voltage driven by the data driver 500 is smaller than what it would have been without the second charge sharing, and as a result, power consumption is reduced.

Meanwhile, in FIG. 2, a TP signal is applied before the 1H period ends, and a rising edge of the TP signal coincides with falling edges of the CS1 signal and the CS2 signal and thus, the end points of the CS1 signal and the CS2 signal are provided. As a result, when a data voltage is applied in the next 1H period, the data lines are controlled to be separated from each other.

Hereinafter, a block diagram of the signal controller 600 and the data driver 500 according to the embodiment will be described with reference to FIG. 3.

Figure 3:
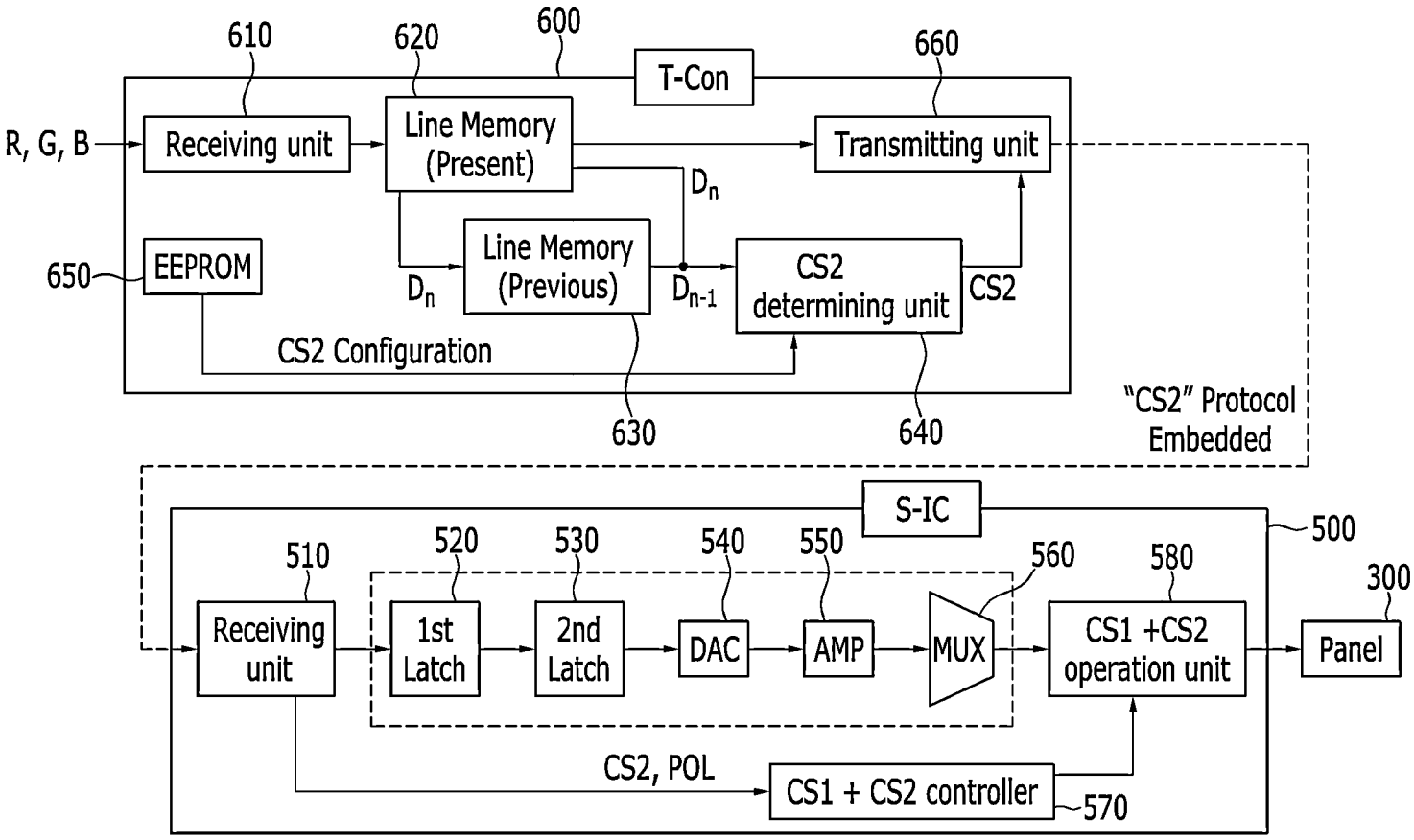
FIG. 3 is a block diagram of a signal controller and a data driver according to the embodiment of the present invention.

FIG. 3 is a block diagram of a signal controller and a data driver according to the embodiment.

In the embodiment of FIG. 3, the signal controller 600 determines the timing for performing the first charge sharing CS1 and the second charge sharing CS2 and transfers the timing to the data driver 500, and the data driver 500 performs the first charge sharing CS1 and the second charge sharing CS2.

The data driver 500 illustrated in FIG. 3 is one data driving IC (S-IC), and the data driver 500 may comprise a plurality of data driving ICs. As a result, the second charge sharing CS2 may be performed in all the data driving ICs simultaneously or separately.

With reference to FIG. 3, an embodiment of the signal controller 600 is described below.

The signal controller 600 according to the embodiment includes a receiving unit 610 for receiving input image signals R, G, and B from an external graphic controller (not illustrated), two line memories 620 and 630 storing the received input image signals R, G, and B, a CS2 determining unit 640, a transmitting unit 660 for outputting a CS2 signal to the data driver 500 together with the image data DAT, and an EEPROM memory 650 storing a basic setting value of the second charge sharing.

The receiving unit 610 separates the input image signals R, G, and B input according to a graphic controller and a transmitting/receiving standard and divides the separated input image signals into input image signals to be applied to pixels in one row of the display panel 300, and stores the divided input image signals in the first line memory 620. Thereafter, the input image signals stored in the first line memory 620 are transmitted to the transmitting unit 660, and further transmitted to the second line memory 630 to compare the input image signals for each row.

The input image signals for each row stored in the first and second line memories 620 and 630 are determined by the CS2 determining unit 640, and the CS2 determining unit 640 determines whether the second charge sharing is to be performed. Since the setting value used in the determination is stored in the EEPROM memory 650, the CS2 determining unit 640 brings and uses the setting value and determines whether the second charge sharing is to be performed based on the retrieved setting value. The CS2 signal output in the CS2 determining unit 640 may be a signal including only whether the CS2 operation is performed or not. Meanwhile, the CS2 determining unit 640 may determine whether the first charge sharing is performed, but in the present embodiment, when the inversion signal POL is applied, the first charge sharing is set to be always performed, and thus a separate determining procedure is not required (and thus omitted). In another embodiment, determination can be made as to whether the first charge sharing is performed, and the CS2 determining unit 640 may be called a charge sharing determining unit.

Thereafter, the transmitting unit 660 converts the input image signals received from the first line memory 620 into the output image signal DAT in accordance with a standard (for example, an RSDS method, a mini-LVDS method, and the like) for transmitting to the data driver 500. Further, the transmitting unit 660 embeds the CS2 signal transferred from the CS2 determining unit 640 into the converted output image signal DAT, and transfers the CS2-embedded signal to the data driver 500. In this case, the CS1 signal for the first charge sharing may also be embedded into the converted output image signal DAT.

Hereinafter, the data driver 500 of FIG. 3 will be described below in detail. The data driver 500 of FIG. 3 may be one data driving IC (S-IC).

The data driver 500 according to the embodiment includes a receiving unit 510 for receiving the output image signal DAT transmitted from the signal controller 600, the CS2 signal, and other control signals (including the POL and the CS1 signal), latch units 520 and 530 for extracting a part of the image data output from the receiving unit 510 and storing the extracted part, a Digital-to-Analog Converter (DAC) unit 540 for converting the stored image data into a data voltage (which is an analog value), an amplifier 550 for amplifying the data voltage, a MUX unit 560 for converting the output according to a polarity, a charge sharing controller (CS1+CS2 controller) 570 for outputting the CS1 signal and the CS2 signal received from the receiving unit 510 during the corresponding timing, and a charge sharing operation unit (CS1+CS2 operation unit) 580 for operating according to a signal of the charge sharing controller 570.

The receiving unit 510 receives the output image signal DAT provided from the signal controller 600 and the control signal to output the image data to the latch units 520 and 530, and the CS1 signal and the CS2 signal are transferred to the charge sharing controller 570.

The image data is converted to the data voltage, and in the embodiment in FIG. 3, the conversion is performed by the latch units 520 and 530, the DAC unit 540, the amplifier 550, and the MUX unit 560.

The first latch unit 52 samples and stores the image data, and samples only the image data corresponding to a data line controlled by the corresponding data driving IC. Thereafter, the second latch unit 530 receives and stores the image data sampled by the first latch unit 520. According to an embodiment, only one latch unit may be included.

Thereafter, the DAC unit 540 converts the image data (which is digital data) stored in the second latch unit 530 into a data voltage (which is an analog value). In this case, the DAC unit 540 may select and convert one of gray voltages in a gray voltage generator (not illustrated).

The amplifier 550 amplifies the data voltage, and the MUX unit 560 controls the data voltage so that the data voltage suitable for the polarity is selected according to the inversion signal POL.

Here, the latch units 520 and 530, the DAC unit 540, the amplifier 550, and the MUX unit 560 represent a general data processing operation of the data driving IC, and according to an embodiment, may be configured by various orders and combinations (e.g., including those that are different from the configuration shown in FIG. 3).

When the image data corresponding to each data line is converted into the data voltage including the polarity by the above operation, the converted data voltage is transferred to the display panel 300. In this case, the converted data voltage may be transferred to the display panel 300 through the charge sharing operation unit 580.

Before a data voltage of the next 1H is applied after the data voltage is transferred to the display panel 300, the charge sharing operation is performed by the CS1 signal and the CS2 signal provided from the charge sharing controller 570. The voltage range to be raised by the data voltage applied in the next 1H is reduced by the charge sharing, and thus the power consumption may be reduced.

Hereinafter, various embodiments of the charge sharing operation unit 580 of one data driving IC of the data driver 500 are described below with reference to FIGS. 4 to 7.

FIGS. 4 to 7 are block diagrams of the data driver according to the embodiment.

Figure 4:
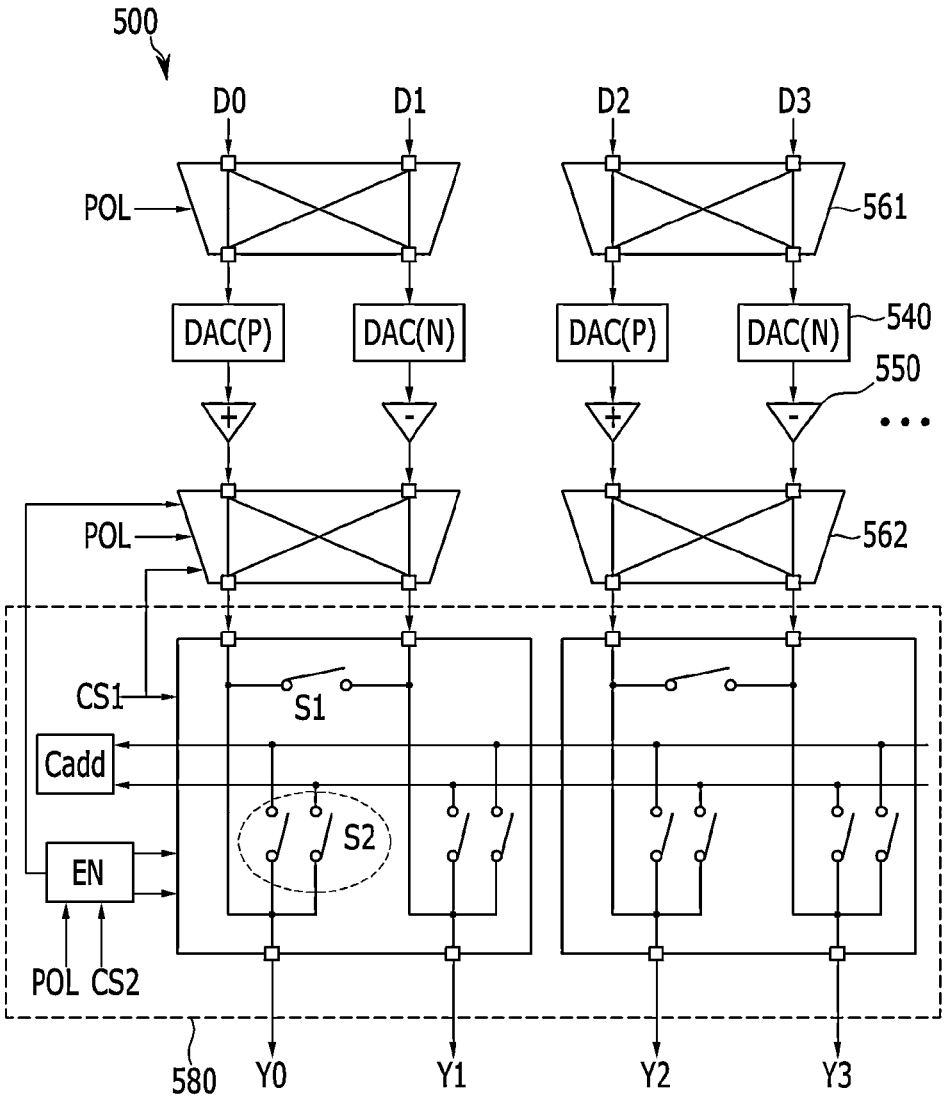
FIGS. 4 to 7 are block diagrams of the data driver according to the embodiment of the present invention.
Figure 5:
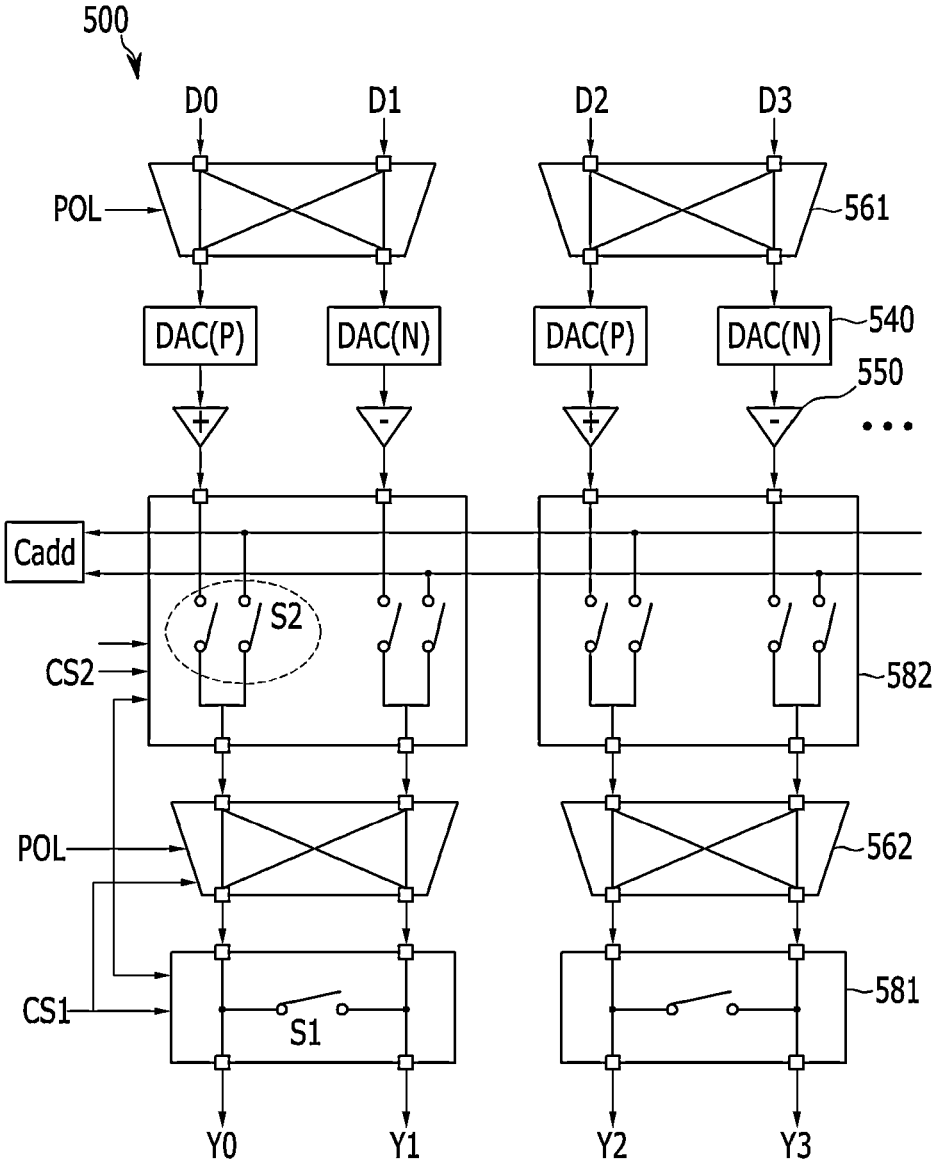
Figure 6:
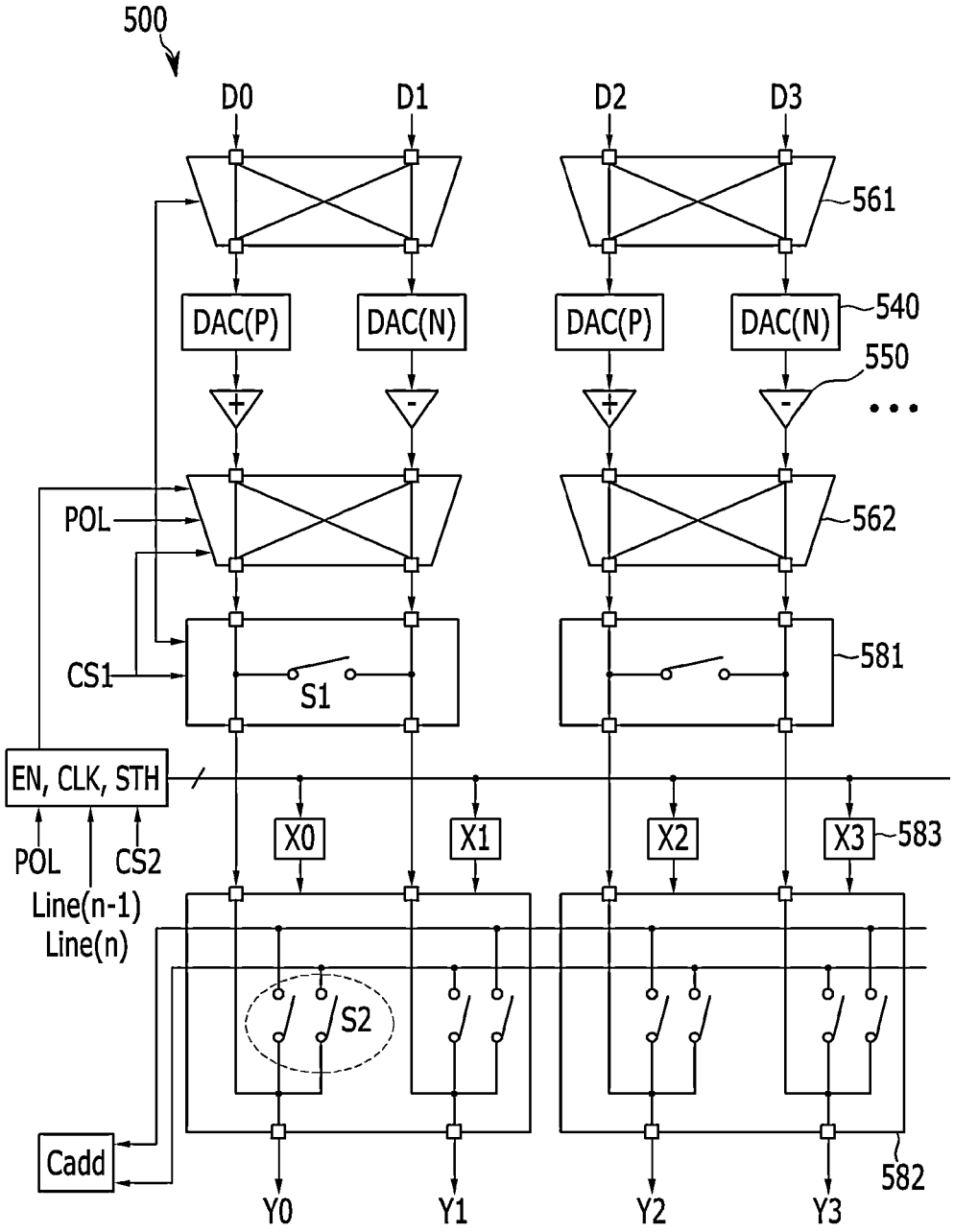
Figure 7:
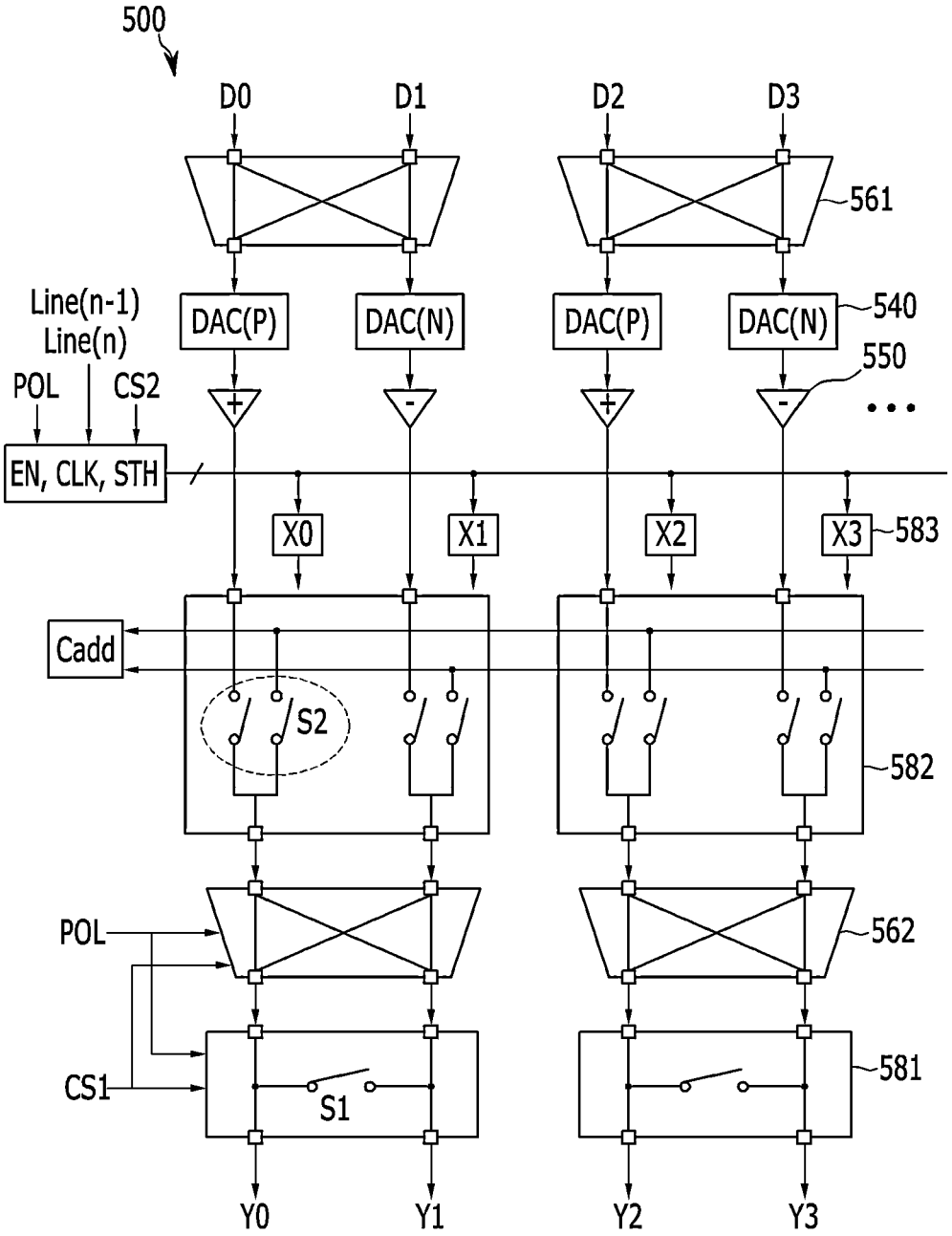

In the embodiments of FIGS. 4 to 7, FIGS. 4 and 5 illustrate embodiments in which the data driver 500 (or each data driving IC within the data driver 500) performs the second charge sharing operation as a unit, and FIGS. 6 and 7 illustrate embodiments in which the second charge sharing operation is selectively performed by an additional control signal for each data line.

First, the data driver 500 according to the embodiment of FIG. 4 will be described.

In the embodiment of FIG. 4, an operation after image data D0, D1, D2, and D3 corresponding to respective data lines Y0, Y1, Y2, and Y3 are determined by the latch unit is illustrated.

In the embodiment of FIG. 4, the data driver 500 includes the MUX unit 560 (which includes a first MUX unit 561 and a second MUX unit 562), a DAC unit 540, an amplifier 550, and a charge sharing operation unit 580.

First, the first MUX unit 561 converts an output terminal according to the inversion signal POL to select and output a path so that each of the image data D0, D1, D2, and D3 may be changed to a data voltage having the corresponding polarity according to the image data.

Thereafter, each of the image data D0, D1, D2, and D3 is converted to the data voltage suitable for the corresponding polarity through the DAC unit 540 and the amplifier 550.

Thereafter, each of the image data D0, D1, D2, and D3 is input to the second MUX unit 562, and a path is rechanged (or changed) to the path suitable for the data line to which the corresponding data voltage is to be applied. In this case, the second MUX unit 562 may operate based on the inversion signal POL, the enable signal EN, and the first charge sharing signal CS1.

Thereafter, the data voltage is input to the charge sharing operation unit 580. The charge sharing operation unit 580 operates based on the inversion signal POL, the enable signal EN, and the first charge sharing signal CS1, and includes a switch S1 for the first charge sharing and a switch S2 for the second charge sharing. The switch S1 for the first charge sharing operates in response to the first charge sharing signal CS1, and in the embodiment, when the first charge sharing signal CS1 has a high level, the S1 switch is closed such that the charge may be shared between the adjacent data lines having opposite polarities. Meanwhile, the switch S2 for the second charge sharing operates in response to the second charge sharing signal CS2, and in the embodiment, when the second charge sharing signal CS2 has a high level, one of two S2 switches is closed according to the inversion signal POL such that the charge may be shared among the data lines having the same polarity and the additional capacitors Cp and Cn. An additional capacitor Cadd (Cp, Cn of FIG. 1) is connected with two short-circuit lines, and the two short-circuit lines are configured to be selectively connected according to a polarity. The additional capacitor Cadd may be formed by two different capacitors based on the polarity, according to the embodiment (e.g., as shown in FIG. 1).

Here, the enable signal EN controls whether the second charge sharing operation is to be performed for each polarity based on the inversion signal POL and the second charge sharing signal CS2.

Referring to FIG. 2, the first and second charge sharing operations may be performed just before the data voltage of the next 1H is applied after the data voltage is applied to the data line.

The data voltage is applied to each data line through the charge sharing operation unit 580.

By such a structure, the first charge sharing and the second charge sharing are performed, and thus a change in voltage driven by the data driver while consuming power is reduced, thereby reducing the power consumption.

Meanwhile, in FIG. 5, unlike FIG. 4, the charge sharing operation unit 580 is divided into the first charge sharing operation unit 581 and the second charge sharing operation unit 582, and the first charge sharing operation unit 581 and the second charge sharing operation unit 582 are separately positioned at a front end and a rear end relative to the second MUX unit 562.

Hereinafter, the data driver 500 according to the embodiment of FIG. 5 will be described in detail.

In the embodiment of FIG. 5, an operation after image data D0, D1, D2, and D3 corresponding to respective data lines Y0, Y1, Y2, and Y3 are determined by the latch unit is illustrated.

In the embodiment of FIG. 5, the data driver 500 includes the MUX unit 560 (which includes a first MUX unit 561 and a second MUX unit 562), a DAC unit 540, an amplifier 550, a first charge sharing operation unit 581, and a second charge sharing operation unit 582.

First, the first MUX unit 561 converts an output terminal according to the inversion signal POL to select and output a path so that each of the image data D0, D1, D2, and D3 may be changed to a data voltage having the corresponding polarity according to the image data.

Thereafter, each of the image data D0, D1, D2, and D3 is converted to the data voltage suitable for the corresponding polarity through the DAC unit 540 and the amplifier 550.

Thereafter, the data voltage is input to the second charge sharing operation unit 582. The second charge sharing operation unit 582 operates based on the second charge sharing signal CS2 and the inversion signal POL, and includes a switch S2 for the second charge sharing. The second charge sharing operation unit 582 closes one of two S2 switches according to the inversion signal POL when the second charge sharing signal CS2 has a high level to share a charge with the data line and the additional capacitor Cadd having the same polarity. The additional capacitor Cadd is connected with two short-circuit lines, and the two short-circuit lines are configured to be selectively connected according to the polarity. The additional capacitor Cadd may be formed by two different capacitors based on the polarity, according to the embodiment (e.g., such as shown in FIG. 1).

Thereafter, each of the image data D0, D1, D2, and D3 is input to the second MUX unit 562, and a path is rechanged (or changed) to the path suitable for the data line to which the corresponding data voltage is to be applied. In this case, the second MUX unit 562 may operate based on the inversion signal POL and the first charge sharing signal CS1.

Thereafter, the data voltage is input to the first charge sharing operation unit 581. The first charge sharing operation unit 581 operates based on the inversion signal POL and the first charge sharing signal CS1, and includes a switch S1 for the first charge sharing. The switch S1 for the first charge sharing operates in response to the first charge sharing signal CS1, and in the embodiment, when the first charge sharing signal CS1 has a high level, the S1 switch is closed such that the charge may be shared between the adjacent data lines having opposite polarities.

Referring to FIG. 2, the first and second charge sharing operations may be performed just before the data voltage of the next 1H is applied after the data voltage is applied to the data line.

The data voltage is applied to each data line through the first charge sharing operation unit 581.

By such a structure, the first charge sharing and the second charge sharing are performed, and thus a change in voltage driven by the data driver while consuming power is reduced, thereby reducing the power consumption.

In the embodiment of FIGS. 4 and 5, the second charge sharing is set so that all the data lines having the same polarity are short-circuited together, or connected with a predetermined data driving IC, and all the data lines having the same polarity are short-circuited together. As a result, a data line may not singly be excluded from the short-circuit.

Hereinafter, a structure in which the participation of each data line in the second charge sharing operation may be controlled will be described with reference to FIGS. 6 and 7.

First, the data driver 500 according to the embodiment of FIG. 6 will be described.

The embodiment of FIG. 6 is similar to the embodiment of FIG. 4, and unlike the embodiment of FIG. 4, the charge sharing operation unit is divided into the first charge sharing operation unit 581 and the second charge sharing operation unit 582, and an independent charge sharing operation unit 583 for controlling the second charge sharing operation unit 582 is also included.

In the embodiment of FIG. 6, an operation after image data D0, D1, D2, and D3 corresponding to respective data lines Y0, Y1, Y2, and Y3 are determined by the latch unit is illustrated.

In the embodiment of FIG. 6, the data driver 500 includes the MUX unit 560 (which includes a first MUX unit 561 and a second MUX unit 562), the DAC unit 540, the amplifier 550, the first charge sharing operation unit 581, the second charge sharing operation unit 582, and the independent charge sharing operation unit 583.

First, the first MUX unit 561 converts an output terminal according to the inversion signal POL to select and output a path so that each of the image data D0, D1, D2, and D3 may be changed to a data voltage having the corresponding polarity according to the image data.

Thereafter, each of the image data D0, D1, D2, and D3 is converted to the data voltage suitable for the corresponding polarity through the DAC unit 540 and the amplifier 550.

Thereafter, each of the image data D0, D1, D2, and D3 is input to the second MUX unit 562, and a path is rechanged (or changed) to the path suitable for the data line to which the corresponding data voltage is applied. In this case, the second MUX unit 562 may operate based on the inversion signal POL, the enable signal EN, and the first charge sharing signal CS1.

Thereafter, the data voltage is input to the first charge sharing operation unit 581. The first charge sharing operation unit 581 operates based on the inversion signal POL and the first charge sharing signal CS1, and includes a switch S1 for the first charge sharing. The switch S1 for the first charge sharing operates by the first charge sharing signal CS1, and in the embodiment, when the first charge sharing signal CS1 has a high level, the S1 switch is closed such that the charge may be shared between the adjacent data lines having opposite polarities.

Thereafter, the data voltage is input to the second charge sharing operation unit 582.

The second charge sharing operation unit 582 operates based on the second charge sharing signal CS2 and the output of the independent charge sharing operation unit 583, and includes a switch S2 for the second charge sharing. The second charge sharing operation unit 582 closes one of two S2 switches according to the inversion signal POL when the second charge sharing signal CS2 has a high level and the output of the independent charge sharing operation unit 583 is a signal (e.g., high level) to perform the second charge sharing operation such that the charge may be shared among the data lines having the same polarity and the additional capacitor Cadd. The additional capacitor Cadd is connected with two short-circuit lines, and the two short-circuit lines are configured to be selectively connected according to the polarity. The additional capacitor Cadd may be formed by two different capacitors based on the polarity, according to the embodiment (e.g., such as shown in FIG. 1).

The independent charge sharing operation unit 583 may output a signal (e.g., high level) to perform the second charge sharing operation by the second charge sharing operation unit 582 and a signal (e.g., low level) not to perform the second charge sharing operation by the second charge sharing operation unit 582. The independent charge sharing operation unit 583 is provided for each data line to control the second charge sharing operation for each data line. The output of the independent charge sharing operation unit 583 may be determined based on an enable signal EN, a clock signal CLK, a vertical synchronization signal STH, an inversion signal POL, a second charge sharing signal CS2, and a data voltage Line(n) in the present row and a data voltage Line(n−1) in the previous row. By comparing the data voltage Line(n) in the present row and the data voltage Line(n−1) in the previous row, when a difference thereof is small, the second charge sharing operation may be unnecessary. For example, the second charge sharing may be performed only when the difference is greater than or equal to a threshold voltage. The threshold voltage may be predetermined.

Referring to FIG. 2, the first and second charge sharing operations may be performed just before the data voltage of the next 1H is applied after the data voltage is applied to the data line.

The data voltage is applied to each data line through the second charge sharing operation unit 582.

By such a structure, the first charge sharing and the second charge sharing are performed, and thus a change in voltage driven by the data driver while consuming power is reduced, thereby reducing the power consumption. Further, the one or more data lines that do not benefit from the charge sharing are omitted, thereby reducing the power consumption.

Meanwhile, in FIG. 7, unlike FIG. 6, the first charge sharing operation unit 581 and the second charge sharing operation unit 582 are separately positioned at the rear end and the front end relative to the second MUX unit 562.

Hereinafter, the data driver 500 according to the embodiment of FIG. 7 will be described in detail.

In the embodiment of FIG. 7, an operation after image data D0, D1, D2, and D3 corresponding to respective data lines Y0, Y1, Y2, and Y3 are determined by the latch unit is illustrated.

In the embodiment of FIG. 7, the data driver 500 includes the MUX unit 560 (which includes a first MUX unit 561 and a second MUX unit 562), the DAC unit 540, the amplifier 550, the first charge sharing operation unit 581, the second charge sharing operation unit 582, and the independent charge sharing operation unit 583.

First, the first MUX unit 561 converts an output terminal according to the inversion signal POL to select and output a path so that each of the image data D0, D1, D2, and D3 may be changed to a data voltage having the corresponding polarity according to the image data.

Thereafter, each of the image data D0, D1, D2, and D3 is converted to the data voltage suitable for the corresponding polarity through the DAC unit 540 and the amplifier 550.

Thereafter, the data voltage is input to the second charge sharing operation unit 582. The second charge sharing operation unit 582 operates based on the second charge sharing signal CS2 and the output of the independent charge sharing operation unit 583, and includes a switch S2 for the second charge sharing. The second charge sharing operation unit 582 closes one of two S2 switches according to the inversion signal POL when the second charge sharing signal CS2 has a high level and the output of the independent charge sharing operation unit 583 is a signal (e.g., high level) to perform the second charge sharing operation such that the charge may be shared among the data lines having the same polarity and the additional capacitor Cadd. The additional capacitor Cadd is connected with two short-circuit lines, and the two short-circuit lines are configured to be selectively connected according to the polarity. The additional capacitor Cadd may be formed by two different capacitors based on the polarity, according to the embodiment (e.g., such as shown in FIG. 1).

The independent charge sharing operation unit 583 may output a signal (e.g., high level) to perform the second charge sharing operation by the second charge sharing operation unit 582 and a signal (e.g., low level) not to perform the second charge sharing operation by the second charge sharing operation unit 582. The independent charge sharing operation unit 583 is provided for each data line to control the second charge sharing operation for each data line. The output of the independent charge sharing operation unit 583 may be determined based on an enable signal EN, a clock signal CLK, a vertical synchronization signal STH, an inversion signal POL, a second charge sharing signal CS2, and a data voltage Line(n) in the present row and a data voltage Line (n−1) in the previous row. By comparing the data voltage Line(n) in the present row and the data voltage Line(n−1) in the previous row, when a difference thereof is small, the second charge sharing operation may be unnecessary.

Thereafter, each of the image data D0, D1, D2, and D3 is input to the second MUX unit 562, and a path is rechanged (or changed) to the path suitable for the data line to which the corresponding data voltage is applied. In this case, the second MUX unit 562 may operate based on the inversion signal POL and the first charge sharing signal CS1.

Thereafter, the data voltage is input to the first charge sharing operation unit 581. The first charge sharing operation unit 581 operates based on the inversion signal POL and the first charge sharing signal CS1, and includes a switch S1 for the first charge sharing. The switch S1 for the first charge sharing operates in response to the first charge sharing signal CS1, and in the embodiment, when the first charge sharing signal CS1 has a high level, the S1 switch is closed such that the charge may be shared between the adjacent data lines having opposite polarities.

Referring to FIG. 2, the first and second charge sharing operations may be performed just before the data voltage of the next 1H is applied after the data voltage is applied to the data line.

The data voltage is applied to each data line through the first charge sharing operation unit 581.

By such a structure, the first charge sharing and the second charge sharing are performed, and thus a change in voltage driven by the data driver while consuming power is reduced, thereby reducing the power consumption. Further, the data lines that do not benefit from the charge sharing are omitted, thereby reducing the power consumption.

In the above embodiment of FIGS. 6 and 7, there is an advantage in that the second charge sharing operation is performed for each data line, but there is a disadvantage in that a circuit structure and a control signal are increased. On the contrary, in the embodiment of FIGS. 4 and 5, there is an advantage in that the circuit structure and the control signal are simple.

Hereinafter, an embodiment in which the data driver 500 determines whether to perform the second charge sharing will be described with reference to FIGS. 8 to 11.

First, a signal controller and a data driver will be described with reference to FIG. 8.

Figure 8:
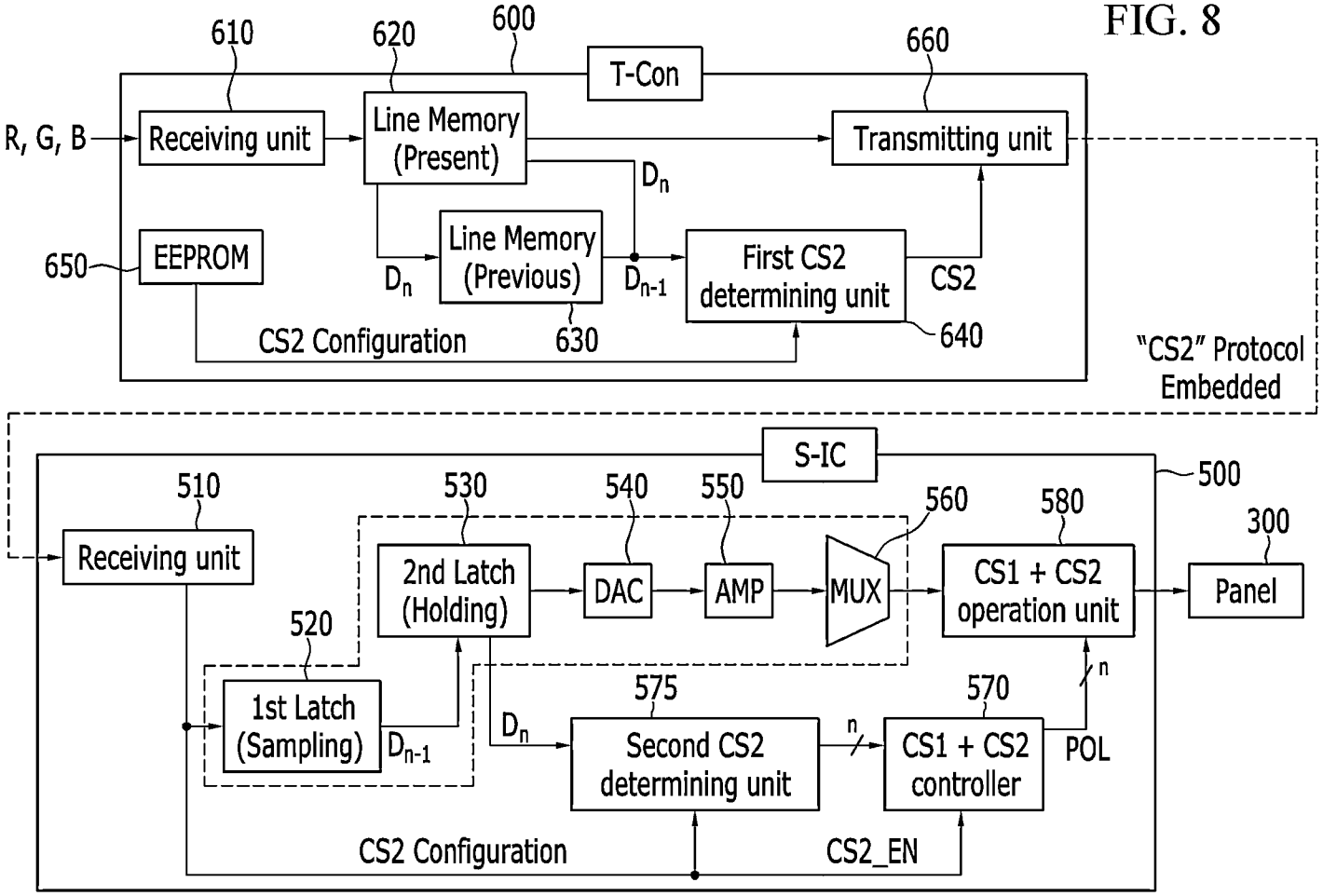
FIG. 8 is a block diagram of a signal controller and a data driver according to another embodiment of the present invention.

FIG. 8 is a block diagram of a signal controller and a data driver according to another embodiment.

In the embodiment of FIG. 8, unlike the embodiment of FIG. 3, the data driver 500 includes a second CS2 determining unit 575 for determining whether the second charge sharing is performed.

That is, the signal controller 600 determines the timing for performing the first charge sharing CS1 and the second charge sharing CS2, and transfers the timing to the data driver 500, but the data driver 500 may also determines and operates whether the second charge sharing CS2 is to be performed through the second CS2 determining unit 575. In this case, the first CS2 determining unit 640 of the signal controller 600 and the second CS2 determining unit 575 of the data driver 500 may have different standards for making the determination, and may be configured to compensate for each other.

The data driver 500 illustrated in FIG. 8 is one data driving IC (S-IC). The data driver 500 may include a plurality of data driving ICs.

First, the signal controller 600 according to the embodiment of FIG. 8 will be described.

The signal controller 600 according to the embodiment includes a receiving unit 610 for receiving input image signals R, G, and B from an external graphic controller (not illustrated), two line memories 620 and 630 for storing the received input image signals R, G, and B, a first CS2 determining unit 640, a transmitting unit 660 for outputting a CS2 signal to the data driver 500 together with image data DAT, and an EEPROM memory 650 for storing a basic setting value of the second charge sharing.

The receiving unit 610 separates the input image signals R, G, and B based on the graphic controller and transmitting/receiving standards and divides the separated image signals into input image signals to be applied to pixels in one row of the display panel 300, and stores the divided input image signals in the first line memory 620. Thereafter, the input image signals stored in the first line memory 620 are transmitted to the transmitting unit 660, and further, transmitted to the second line memory 630 such that the input image signals for each row may be compared.

The input image signals for each row stored in the first and second line memories 620 and 630 are determined by the first CS2 determining unit 640, and the first CS2 determining unit 640 determines whether the second charge sharing is to be performed. Since the setting value used in the determination is stored in the EEPROM memory 650, the first CS2 determining unit 640 retrieves the setting value and determines whether the second charge sharing is to be performed based on the retrieved setting value. The CS2 signal output in the first CS2 determining unit 640 may be a signal including only whether the CS2 operation is performed or not. Meanwhile, the first CS2 determining unit 640 may determine whether the first charge sharing is performed, but in the present embodiment, when the inversion signal POL is applied, the first charge sharing is set to be always performed, and thus a separate determining procedure is not required (and thus omitted). Even in the case of determining whether the first charge sharing is performed, the first CS2 determining unit 640 may be called a charge sharing determining unit.

Thereafter, the transmitting unit 660 converts the input image signals received from the first line memory 620 into the output image signal DAT in accordance with a standard (for example, an RSDS method, a mini-LVDS method, and the like) for transmitting to the data driver 500. Further, the transmitting unit 660 embeds the CS2 signal transferred from the first CS2 determining unit 640 into the converted output image signal DAT, and transfers the CS-2 embedded signal to the data driver 500. In this case, the CS1 signal for the first charge sharing may also be embedded into the converted output image signal DAT.

Hereinafter, the data driver 500 of FIG. 8 will be described in detail. The data driver 500 of FIG. 8 may be one data driving IC (S-IC).

The data driver 500 according to the embodiment includes a receiving unit 510 for receiving the output image signal DAT transmitted from the signal controller 600, the CS2 signal, and other control signals (including the POL and the CS1 signal), latch units 520 and 530 for extracting a part of the image data output from the receiving unit 510 and storing the extracted part, a DAC unit 540 for converting the stored image data into a data voltage which is an analog value, an amplifier 550 for amplifying the data voltage, a MUX unit 560 for converting the output according to a polarity, a charge sharing controller (CS1+CS2 controller) 570 for outputting the CS1 signal and the CS2 signal received from the receiving unit 510 during the corresponding timing, a charge sharing operation unit (CS1+CS2 operation unit) 580 for operating according to a signal of the charge sharing controller, and a second CS2 determining unit 575 for determining additionally whether the second charge sharing is to be performed.

The receiving unit 510 receives the output image signal DAT provided from the signal controller 600 and the control signal to output the image data to the latch units 520 and 530, and the CS1 signal and the CS2 signal are transferred to the charge sharing controller 570.

The image data is converted to the data voltage, and in the embodiment in FIG. 8, the conversion is performed by the latch units 520 and 530, the DAC unit 540, the amplifier 550, and the MUX unit 560.

The first latch unit 52 samples and stores the image data, and samples only the image data corresponding to a data line controlled by the corresponding data driving IC. Thereafter, the second latch unit 530 receives and stores the image data sampled by the first latch unit 520. According to an embodiment, only one latch unit may be included. The second latch unit 530 transfers the image data to the DAC unit 540 and the second CS2 determining unit 575.

Thereafter, the DAC unit 540 converts the image data (which is digital data) stored in the second latch unit 530 into a data voltage (which is an analog value). In this case, the DAC unit 540 may select and convert one of gray voltages in a gray voltage generator (not illustrated).

The amplifier 550 amplifies the data voltage, and the MUX unit 560 controls the data voltage so that the data voltage suitable for the polarity is selected according to the inversion signal POL.

Here, the latch units 520 and 530, the DAC unit 540, the amplifier 550, and the MUX unit 560 represent a general data processing operation of the data driving IC, and according to an embodiment, may be configured by various orders and combinations (e.g., including those that are different from the configuration shown in FIG. 8).

When the image data corresponding to each data line is converted into the data voltage including the polarity by the above operation, the converted data voltage is transferred to the display panel 300. In this case, the converted data voltage may be transferred to the display panel 300 through the charge sharing operation unit 580.

Before a data voltage of the next 1H is applied after the data voltage is transferred to the display panel 300, the charge sharing operation is performed by the CS1 signal and the CS2 signal provided from the charge sharing controller 570, and a CS2_EN signal provided by the second CS2 determining unit 575.

The second CS2 determining unit 575 outputs the CS2_EN signal, and the method of determining the level of the CS2_EN signal based on the image data in the second CS2 determining unit 575 may be various methods, and hereinafter, a simple determining method using only the MSB will be described. However, the determination method is not limited to such configuration, and may include any other determination method.

That is, since an MSB value of 0 in the image data means a lower gray and the MSB value of 1 means an upper gray, and if the MSB value is changed for every 1H, it means that the MSB value switches sides with respect to the intermediate gray. Therefore, in such a case, the data voltage applied to one data line is changed upward and downward toward (or crossing) the data voltage of the intermediate gray through the second charge sharing. That is, the second CS2 determining unit 575 compares image data applied to one data line for every 1H to generate a high level of the CS2_EN signal when the MSB is changed, and operate the CS2 (the second charge sharing) accordingly.

The CS2_EN signal provided from the second CS2 determining unit 575 may control the second charge sharing for each data line.

The voltage range to be raised by the data voltage applied in the next 1H is reduced by the charge sharing, and thus the power consumption may be reduced.

A detailed block structure of such a data driver 500 will be described in detail with reference to FIG. 9.

Figure 9:
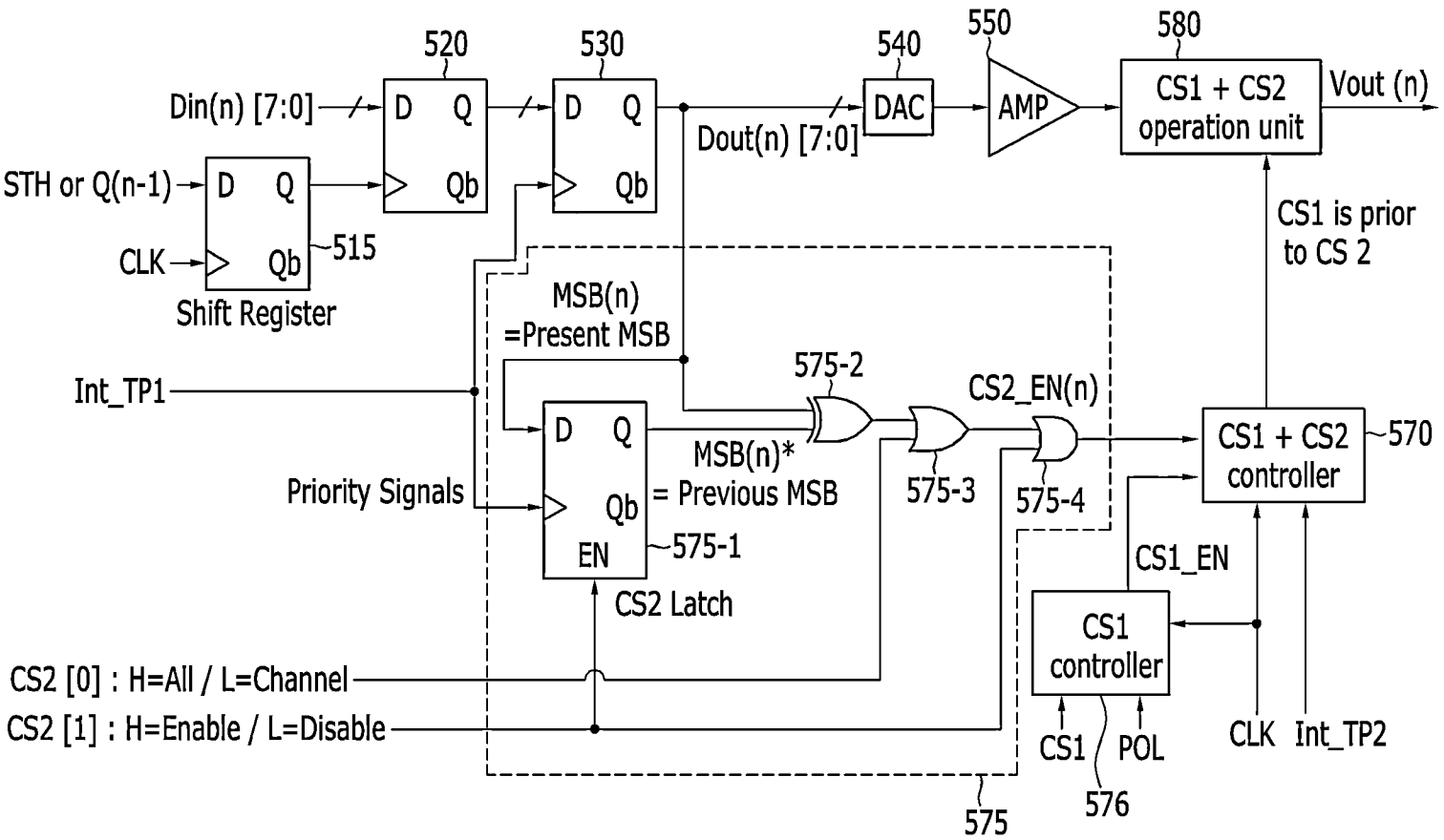
FIG. 9 is a block diagram of the data driver according to another embodiment of the present invention.

FIG. 9 is a block diagram of the data driver according to another embodiment.

In FIG. 9, a part of the second CS2 determining unit 575 which outputs the CS2_EN signal through the MSB is illustrated in detail.

In comparison with FIG. 8, in FIG. 9, a shift register 515 and a CS1 controller 576 are further included. The shift register 515 is omitted in FIGS. 3 and 8 as a constituent element generally included in the data driver 500. When a series of image data are input, the shift register 515 serves to store only the image data required for the corresponding data driving IC, and to transfer subsequent image data to the next data driving IC.

The image data output from the second latch unit 530 is also input to the second CS2 determining unit 575. The second CS2 determining unit 575 includes a CS2 latch unit 575-1 for storing the input image data, an XOR unit 575-2, an OR unit 575-3, and an AND unit 575-4. In this case, the signal input to the second CS2 determining unit 575 includes a CS2[0] signal which is a signal for distinguishing whether the second charge sharing is to be performed in all the data lines or is to be performed independently (e.g., for each channel, for each data line, for each data driving IC, and etc.), and a CS2[1] signal which is a signal for distinguishing whether the second charge sharing is to be used or not to be used. Further, a TP1 signal applied to the CS2 latch unit 575-1 is applied.

The second CS2 determining unit 575 outputs the CS2_EN signal according to the output of the XOR unit 575-2, the OR unit 575-3, and the AND unit 575-4.

First, the XOR unit 575-2 receives an MSB of the present image data and an MSB of the image data from the previous 1H stored in the CS2 latch unit 575-1 to output 0 when the two MSBs are the same, and output 1 when the two MSBs are different.

Thereafter, the OR unit 575-3 compares the output of the XOR unit 575-2 and the CS2[0] to output 1 when one of the two is 1, and output 0 when they are both 0. Therefore, the output of the OR unit 575-3 is 1 when the output of the XOR unit 575-2 is 1 (the two MSBs are different), or the second charge sharing is set to be performed with respect to all the data lines, and is 0 only when the two MSBs are equal to each other when the second charge sharing is to be independently performed.

Thereafter, the AND unit 575-4 outputs 1 to the CS2_EN only when the output of the OR unit 575-3 is 1 and the CS2[1] value is 1. Therefore, when the CS2[1] value is set to 0, the value of the CS2_EN is 1 and thus the independent second charge sharing is not performed.

The charge sharing operation unit 580 operates according to the control signal provided by the charge sharing controller 570 based on the CS2_EN signal output by the second CS2 determining unit 575.

Meanwhile, in the embodiment of FIG. 9, an output signal CS1_EN of the CS1 controller 576 is also applied to the charge sharing controller 570, and the CS1 controller 576 outputs the CS1_EN signal according to the inversion signal POL together with the CS1 signal provided from the signal controller 600. The CS1 controller 576 may control the CS1 operation to be entirely used from the outside or not to be used from the outside.

According to the embodiment of FIG. 9, the charge sharing controller 570 considers the CS2_EN signal, which is output from the second CS2 determining unit 575, and the CS1_EN signal, which is output from the CS1 controller 576, and operates in response to a clock signal CLK and a TP2 signal.

Hereinafter, the change in voltage in various types of second charge sharing will be described with reference to FIGS. 10 to 12.

Figure 10:
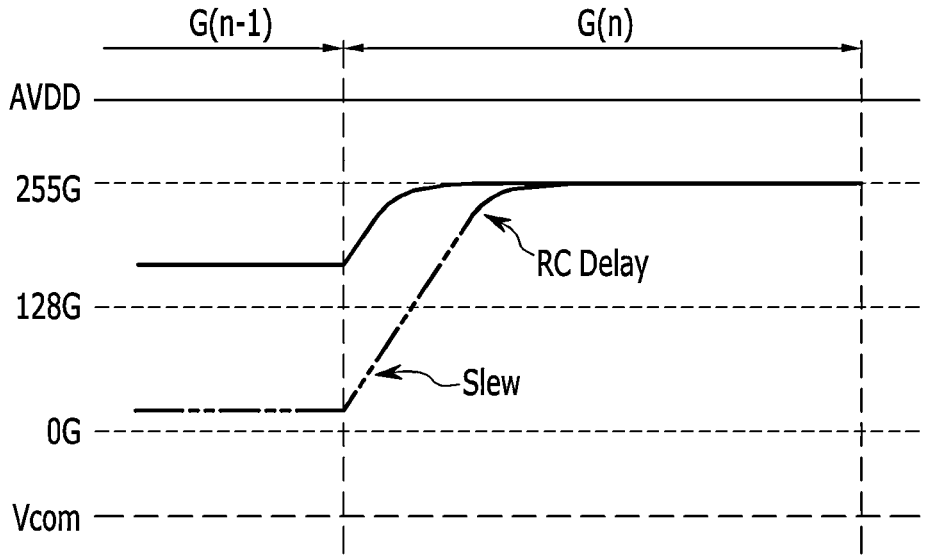
FIGS. 10 to 12 are graphs illustrating a comparison of a voltage change according to embodiments of second charge sharing according to the present invention.
Figure 11:
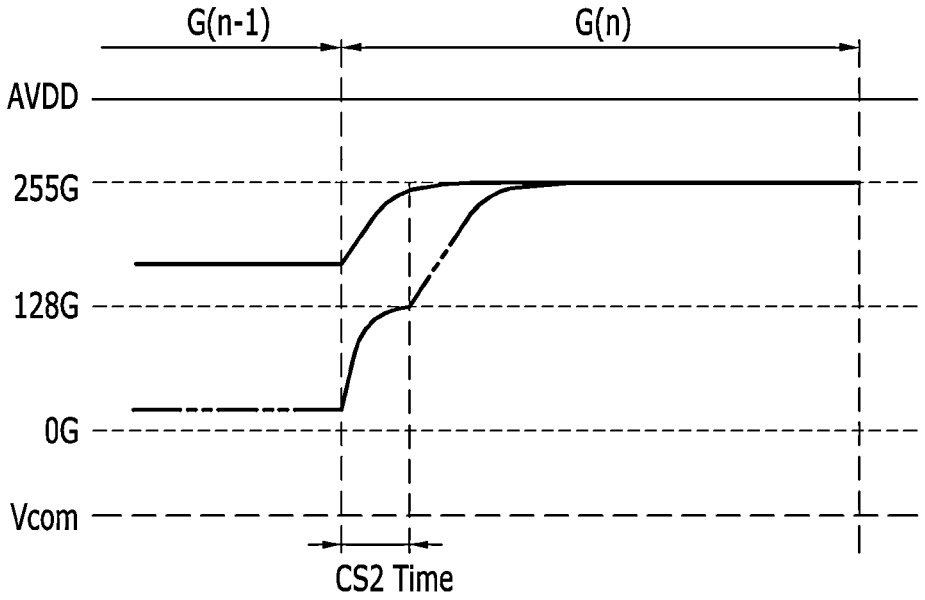
Figure 12:
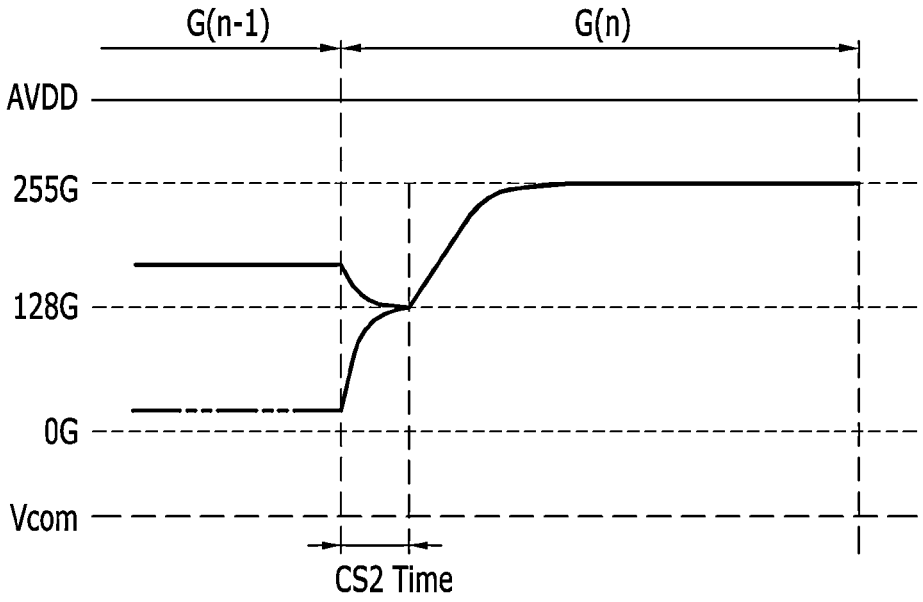

FIGS. 10 to 12 are graphs illustrating a comparison of a voltage change in different types of second charge sharing according to embodiments.

First, in FIG. 10, a voltage change when the second charge sharing is not performed is illustrated. That is, when one data line has a positive voltage having a low gray and the other data line has a positive voltage of an intermediate gray (128G) or more in the current frame (n−1th frame), a change in voltage in the case where both data lines express a maximum gray (255G) in the next frame (n-th frame) is illustrated.

As shown in FIG. 10, for the data line representing the low gray, the RC delay for reaching the target voltage is very large. In the other data line, which requires a smaller change in voltage to reach the target voltage, there still is some RC delay but it is relatively small, as shown in FIG. 10.

FIG. 11 illustrates an embodiment in which the second charge sharing is independently performed in the same situation as that illustrated in FIG. 10, and the second charge sharing is performed only for the data line of the low gray. The second charge sharing is not performed with respect to the data line expressing the intermediate gray (128G) or more. Such a second charge sharing method is referred to as an independent second charge sharing.

According to FIG. 11, since the data line of the low gray reaches the value of the intermediate gray (128G) through the second charge sharing and thereafter, transitions to a maximum gray, a width of the voltage change is reduced, and as a result, a time of the RC delay is reduced as compared with the embodiment of FIG. 10. During the independent second charge sharing of FIG. 11, the data line having the intermediate gray or more in which the second charge sharing is not performed has the same delay time as FIG. 10.

Meanwhile, FIG. 12 illustrates an embodiment in which the second charge sharing is performed with respect to all the data lines in the same situation as FIG. 10. Such a second charge sharing method is referred to as a global second charge sharing.

Since the second charge sharing is performed with respect to all the data lines, in the embodiment of FIG. 12, the data line having the intermediate gray or more has a voltage value of the intermediate gray and then is changed to a maximum gray which is a target gray. In this case, in the data line having the intermediate gray or more, the voltage change needed to reach the target voltage was increased by the second charge sharing.

In summary, when the second charge sharing is not performed (e.g., in the example of FIG. 10), a deviation in charge rate of the pixel connected to each data line may occur due to the RC delay. On the contrary, in the case of the independent second charge sharing (e.g., in the example of FIG. 11), the width of the voltage change in each data line is at its smallest, and thus the power consumption is at its smallest. However, since the voltage difference of each data line still occurs, the deviation in charge rate of the pixel connected to each data line may occur. Further, since whether the second charge sharing is performed in any data line may need to be separately determined, an additional determining unit may be required. Meanwhile, in the global second charge sharing (e.g., in the example of FIG. 12), more power is consumed than in the independent second charge sharing, but a moving path of the data line voltages after the second charge sharing is the same and thus there is little deviation in the charge rate of the pixel connected to each data line.

As such, a different second charge sharing method may be applied depending on the need.

Hereinafter, various embodiments of the charge sharing operation unit 580 of one data driving IC of the data driver 500 will be described with reference FIGS. 13 and 14.

Figure 13:
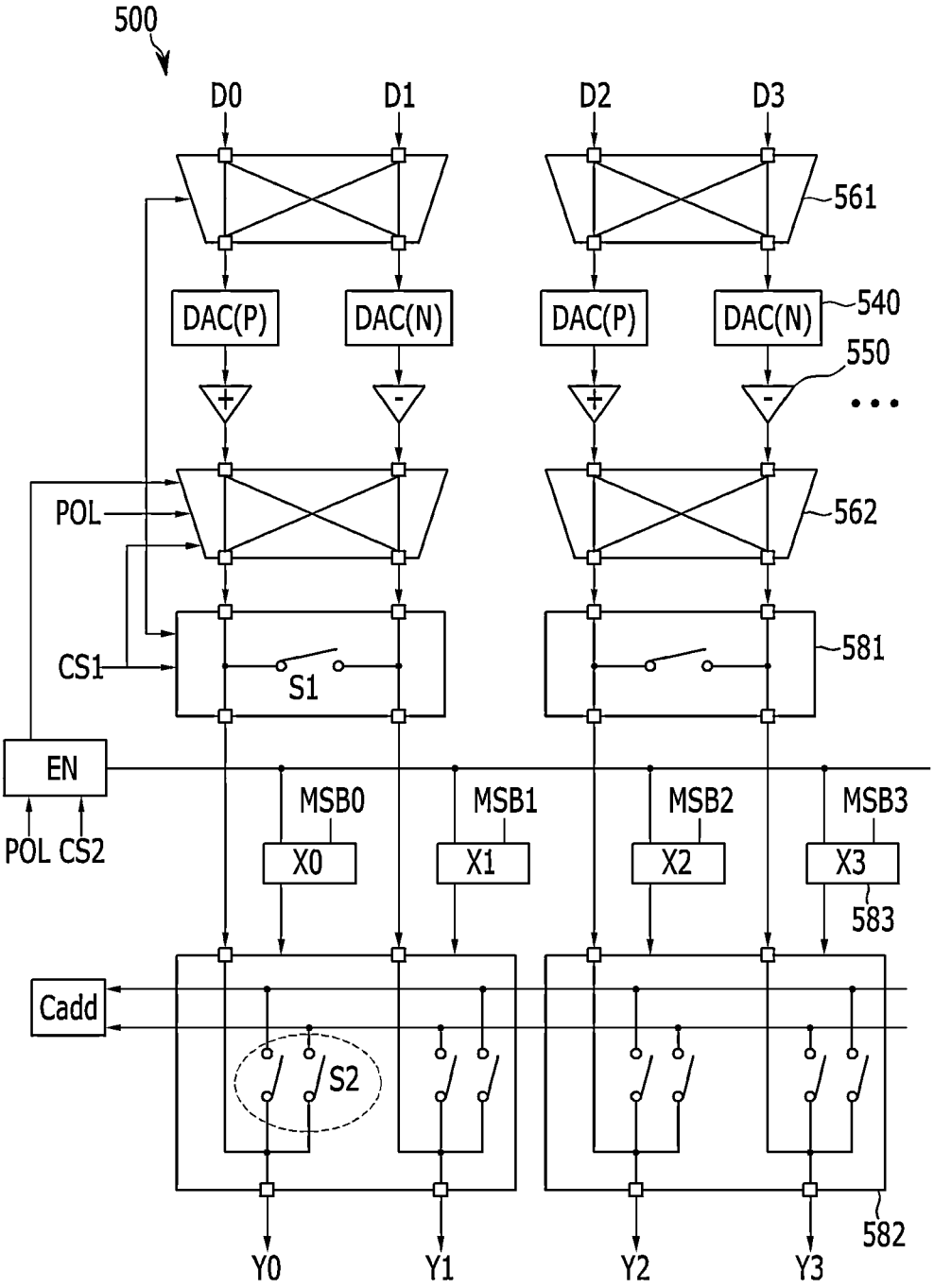
FIGS. 13 and 14 are block diagrams of the data driver according to the embodiment of the present invention.
Figure 14:
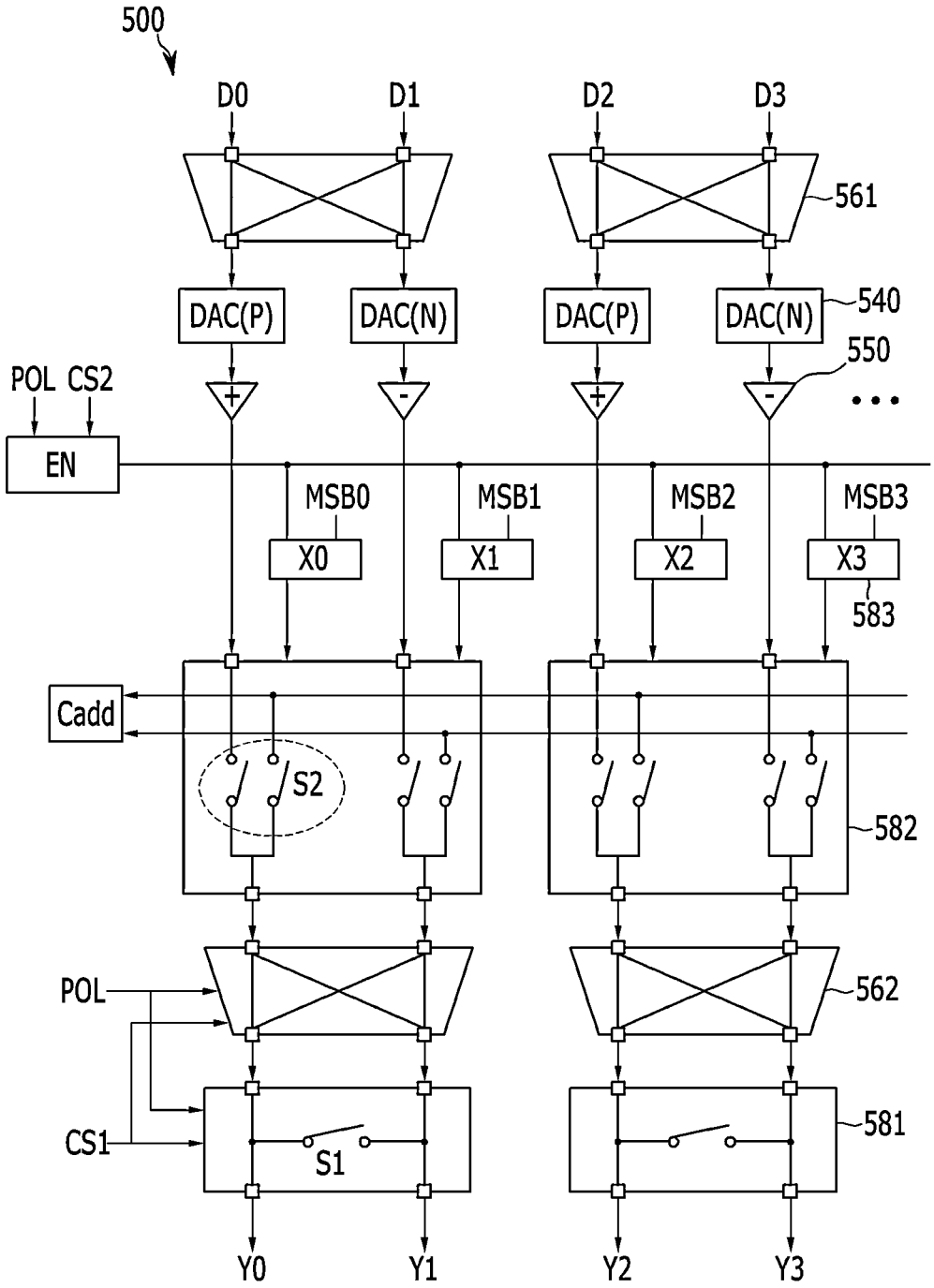

FIGS. 13 and 14 are block diagrams of the data driver according to the embodiment.

The data driver 500 according to the embodiment of FIGS. 13 and 14 may control a second charge sharing operation for each data line like the embodiment of FIGS. 6 and 7. However, in the embodiment of FIGS. 13 and 14, there is a difference in that an independent charge sharing operation unit 583 operates by comparing only the MSBs.

First, the data driver 500 according to the embodiment of FIG. 13 will be described.

In the embodiment of FIG. 13, an operation after image data D0, D1, D2, and D3 corresponding to respective data lines Y0, Y1, Y2, and Y3 are determined by the latch unit is illustrated.

In the embodiment of FIG. 13, the data driver 500 includes the MUX unit 560 (which includes a first MUX unit 561 and a second MUX unit 562), the DAC unit 540, the amplifier 550, the first charge sharing operation unit 581, the second charge sharing operation unit 582, and the independent charge sharing operation unit 583. Here, the independent charge sharing operation unit 583 compares the MSB of the data applied to the previous 1H and the MSB of the data applied to the subsequent 1H, and if the MSBs are different from each other, the independent charge sharing operation unit 583 outputs a signal for causing the second charge sharing to be performed.

First, the first MUX unit 561 converts an output terminal according to the inversion signal POL to select and output a path so that each of the image data D0, D1, D2, and D3 may be changed to a data voltage having the corresponding polarity according to the image data.

Thereafter, each of the image data D0, D1, D2, and D3 is converted to the data voltage suitable for the corresponding polarity through the DAC unit 540 and the amplifier 550.

Thereafter, each of the image data D0, D1, D2, and D3 is input to the second MUX unit 562, and a path is rechanged (or changed) to the path suitable for the data line to which the corresponding data voltage is applied. In this case, the second MUX unit 562 may operate based on the inversion signal POL, the enable signal EN, and the first charge sharing signal CS1.

Thereafter, the data voltage is input to the first charge sharing operation unit 581. The first charge sharing operation unit 581 operates based on the inversion signal POL and the first charge sharing signal CS1, and includes a switch S1 for the first charge sharing. The switch S1 for the first charge sharing operates in response to the first charge sharing signal CS1, and in the embodiment, when the first charge sharing signal CS1 has a high level, the S1 switch is closed such that the charge may be shared between the adjacent data lines having opposite polarities.

Thereafter, the data voltage is input to the second charge sharing operation unit 582.

The second charge sharing operation unit 582 operates based on the output of the second charge sharing signal CS2 and the independent charge sharing operation unit 583, and includes a switch S2 for the second charge sharing. The second charge sharing operation unit 582 closes one of two S2 switches according to the inversion signal POL when the second charge sharing signal CS2 has a high level and the output of the independent charge sharing operation unit 583 is a signal (e.g., high level) to perform the second charge sharing operation such that the charge may be shared among the data lines having the same polarity and the additional capacitor Cadd. The additional capacitor Cadd is connected with two short-circuit lines, and the two short-circuit lines are configured to be selectively connected based on the polarity. The additional capacitor Cadd may be formed by two different capacitors based on the polarity, according to the embodiment such as shown in FIG. 1.

The independent charge sharing operation unit 583 may output a signal (e.g., high level) to perform the second charge sharing operation by the second charge sharing operation unit 582 and a signal (e.g., low level) not to perform the second charge sharing operation by the second charge sharing operation unit 582. Here, the independent charge sharing operation unit 583 compares the MSB of the data applied to the previous 1H and the MSB of the data applied to the subsequent 1H to output an output signal to perform the second charge sharing in the case where the MSBs are different from each other.

Referring to FIG. 2, the first and second charge sharing operations may be performed just before the data voltage of the next 1H is applied after the data voltage is applied to the data line.

The data voltage is applied to each data line through the second charge sharing operation unit 582.

By such a structure, the first charge sharing and the second charge sharing are performed, and thus a change in voltage driven by the data driver while consuming power is reduced, thereby reducing the power consumption. Further, the unnecessary data line does not perform the charge sharing, thereby reducing the power consumption.

Meanwhile, in FIG. 14, unlike FIG. 13, the first charge sharing operation unit 581 and the second charge sharing operation unit 582 are separately positioned at the rear end and the front end based on the second MUX unit 562.

Hereinafter, the data driver 500 according to the embodiment of FIG. 14 will be described in detail.

In the embodiment of FIG. 14, an operation after image data D0, D1, D2, and D3 corresponding to respective data lines Y0, Y1, Y2, and Y3 are determined by the latch unit is illustrated.

In the embodiment of FIG. 14, the data driver 500 includes the MUX unit 560 (which includes a first MUX unit 561 and a second MUX unit 562), the DAC unit 540, the amplifier 550, the first charge sharing operation unit 581, the second charge sharing operation unit 582, and the independent charge sharing operation unit 583. Here, the independent charge sharing operation unit 583 compares the MSB of the data applied to the previous 1H and the MSB of the data applied to the subsequent 1H to output an output signal to perform the second charge sharing in the case where the MSBs are different from each other.

First, the first MUX unit 561 converts an output terminal according to the inversion signal POL to select and output a path so that each of the image data D0, D1, D2, and D3 may be changed to a data voltage having the corresponding polarity according to the image data.

Thereafter, each of the image data D0, D1, D2, and D3 is converted to the data voltage suitable for the corresponding polarity through the DAC unit 540 and the amplifier 550.

Thereafter, the data voltage is input to the second charge sharing operation unit 582. The second charge sharing operation unit 582 operates based on the output of the second charge sharing signal CS2 and the independent charge sharing operation unit 583, and includes a switch S2 for the second charge sharing. The second charge sharing operation unit 582 closes one of two S2 switches according to the inversion signal POL when the second charge sharing signal CS2 has a high level and the output of the independent charge sharing operation unit 583 is a signal (e.g., high level) to perform the second charge sharing operation such that the charge may be shared among the data lines having the same polarity and the additional capacitor Cadd. The additional capacitor Cadd is connected with two short-circuit lines, and the two short-circuit lines are configured to be selectively connected based on the polarity. The additional capacitor Cadd may be formed by two different capacitors based on the polarity according to the embodiment such as shown in FIG. 1.

The independent charge sharing operation unit 583 may output a signal (e.g., high level) to perform the second charge sharing operation by the second charge sharing operation unit 582 and a signal (e.g., low level) not to perform the second charge sharing operation by the second charge sharing operation unit 582. The independent charge sharing operation unit 583 compares the MSB of the data applied to the previous 1H and the MSB of the data applied to the subsequent 1H to output an output signal to perform the second charge sharing in the case where the MSBs are different from each other.

Thereafter, each of the image data D0, D1, D2, and D3 is input to the second MUX unit 562, and a path is rechanged (or changed) to the path suitable for the data line to which the corresponding data voltage is applied. In this case, the second MUX unit 562 may operate based on the inversion signal POL and the first charge sharing signal CS1.

Thereafter, the data voltage is input to the first charge sharing operation unit 581. The first charge sharing operation unit 581 operates based on the inversion signal POL and the first charge sharing signal CS1, and includes a switch S1 for the first charge sharing. The switch S1 for the first charge sharing operates by the first charge sharing signal CS1, and in the embodiment, when the first charge sharing signal CS1 has a high level, the S1 switch is closed such that the charge may be shared between the adjacent data lines having opposite polarities.

Referring to FIG. 2, the first and second charge sharing operations may be performed just before the data voltage of the next 1H is applied after the data voltage is applied to the data line.

The data voltage is applied to each data line through the first charge sharing operation unit 581.

By such a structure, the first charge sharing and the second charge sharing are performed, and thus the change in voltage driven by the data driver while consuming power is reduced, thereby reducing the power consumption. Further, the unnecessary data line does not perform the charge sharing, thereby reducing the power consumption.

In the above embodiment of FIGS. 13 and 14, there is an advantage in that the second charge sharing operation is performed for each data line, but there is a disadvantage in that a circuit structure and a control signal are increased. However, in the embodiment of FIGS. 13 and 14, since the independent charge sharing operation unit 583 compares only the two MSBs, the additional circuit structure is simple and an independent control is possible.

Hereinafter, a characteristic of the voltage change according to the embodiment will be described with reference to FIGS. 15 and 16.

Figure 15:
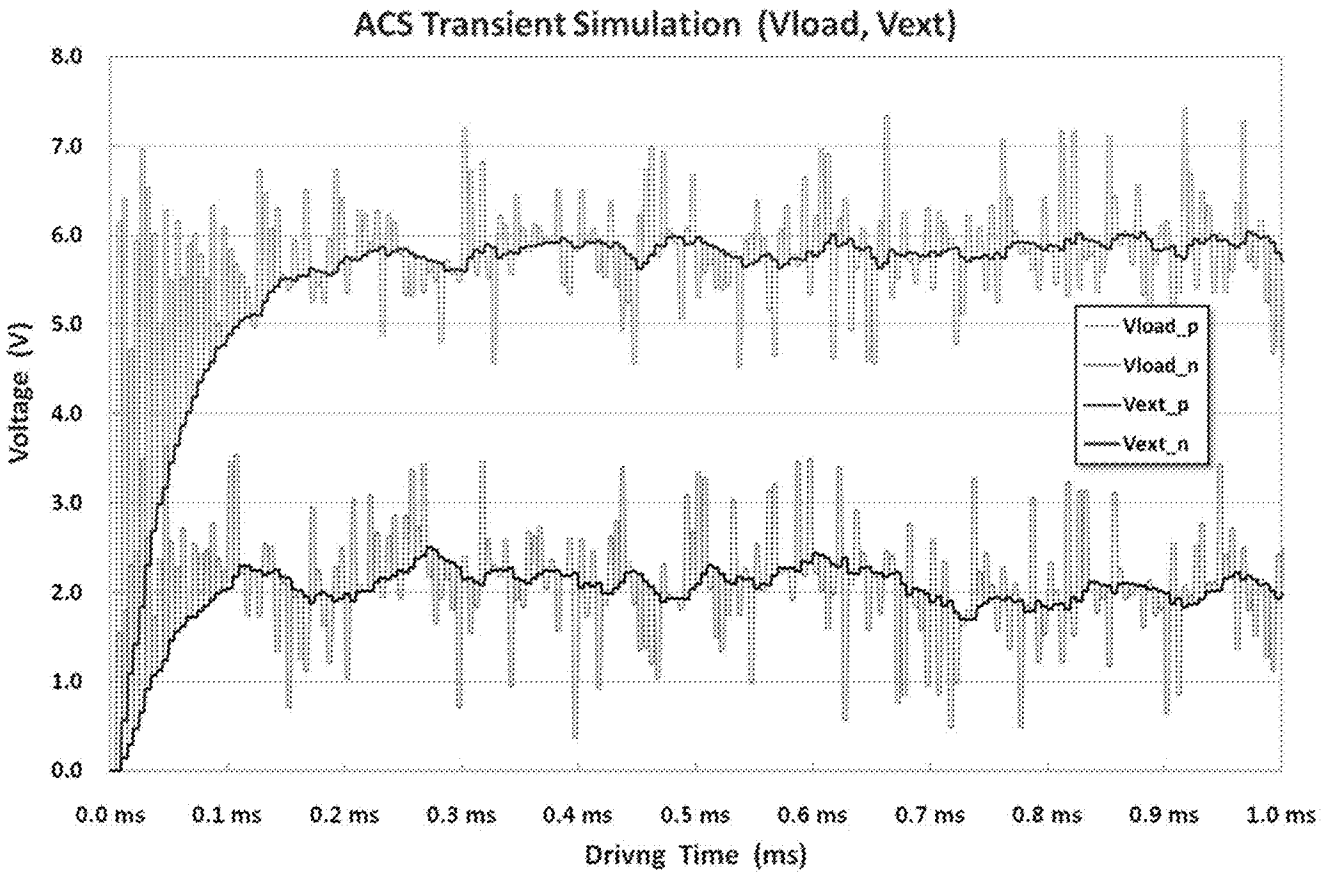
FIGS. 15 and 16 are graphs simulating a voltage change according to the embodiment of the present invention.
Figure 16:
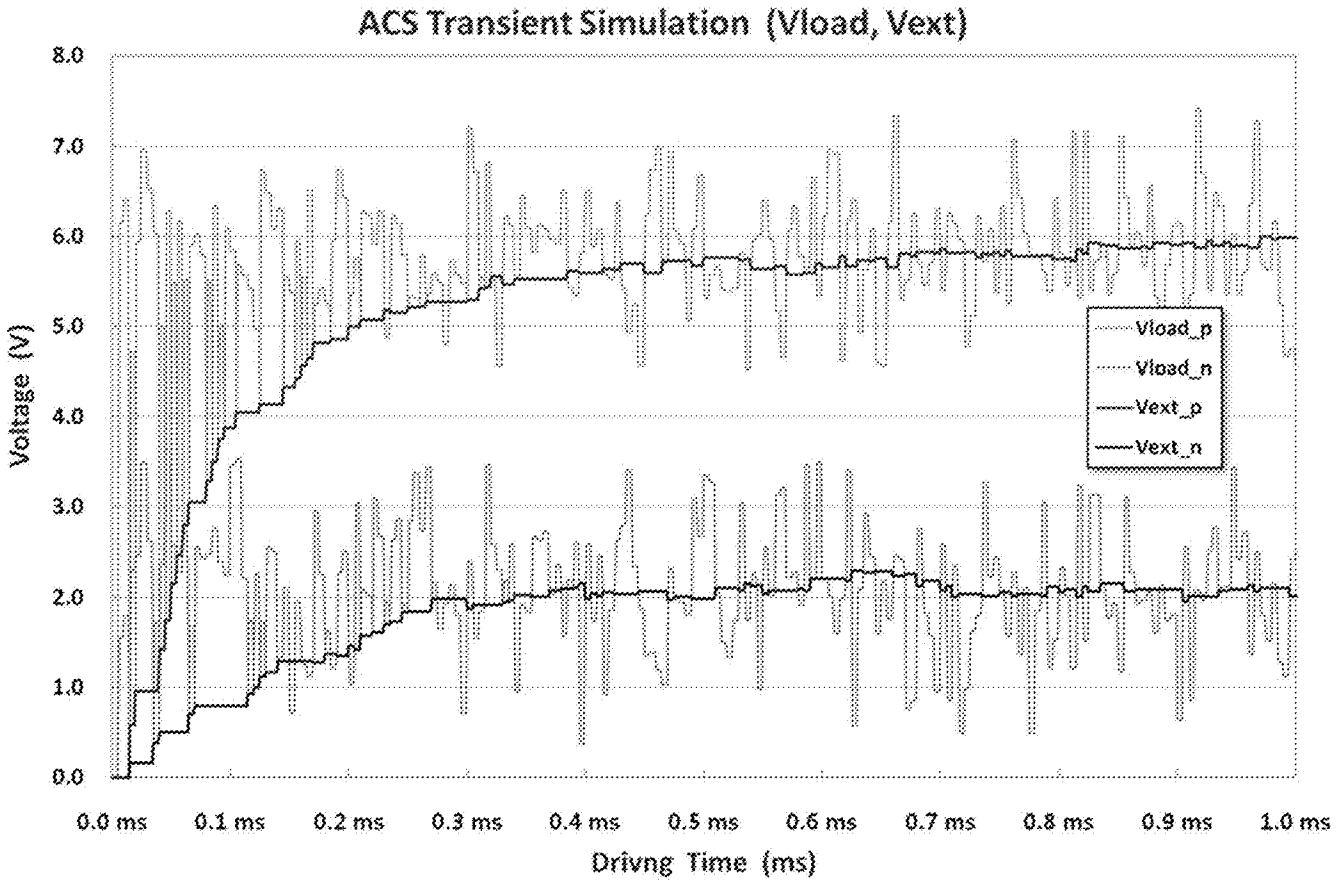

FIGS. 15 and 16 are graphs simulating a voltage change according to the embodiment.

The graphs of FIGS. 15 and 16 illustrate a change in voltage according to a driving time, and thick solid lines Vext_p and Vext_n represent voltage values obtained by the second charge sharing, and thin lines Vload_p and Vload_n represent respective data loads. Further, in FIGS. 12 and 13, p means a positive polarity, and n means a negative polarity.

FIG. 15 illustrates a case where the second charge sharing CS2 operation is always performed, and FIG. 16 illustrates a case where the second charge sharing CS2 operation is performed only when passing the intermediate gray.

In the case of the embodiment of FIG. 16, as shown in FIG. 16, the width of the voltage change is small and thus the power consumption is smaller. That is, in the case where the second charge sharing CS2 is always performed (e.g., FIG. 15), the power consumption may be rather increased. Thus, if reducing the power consumption is the primary concern, the example of FIG. 16 may be used, where the second charge sharing CS2 is selectively performed.

Hereinafter, a structure of a display device according to various embodiments of the second charge sharing will be described.

Figure 17:
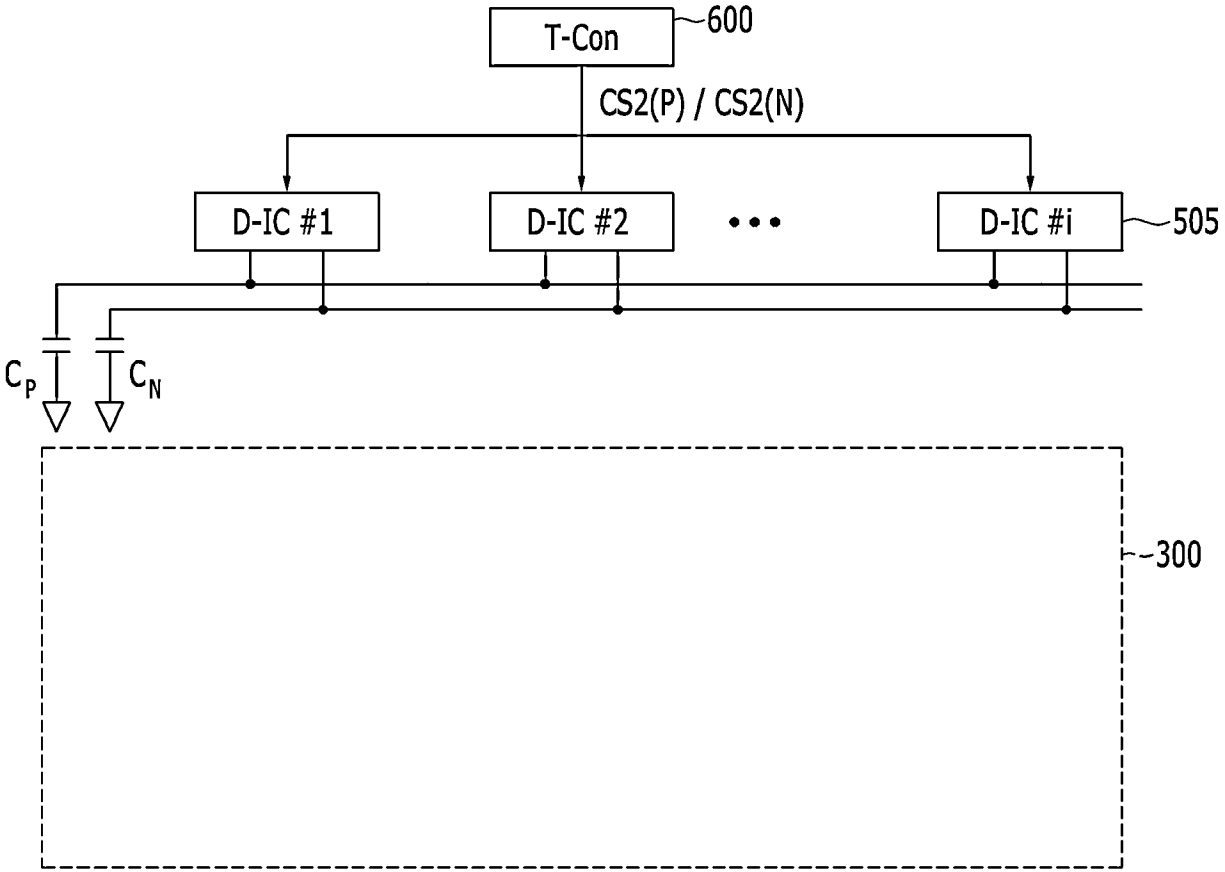
FIGS. 17 to 19 are block diagrams of a liquid crystal display according to an embodiment of the present invention.
Figure 18:
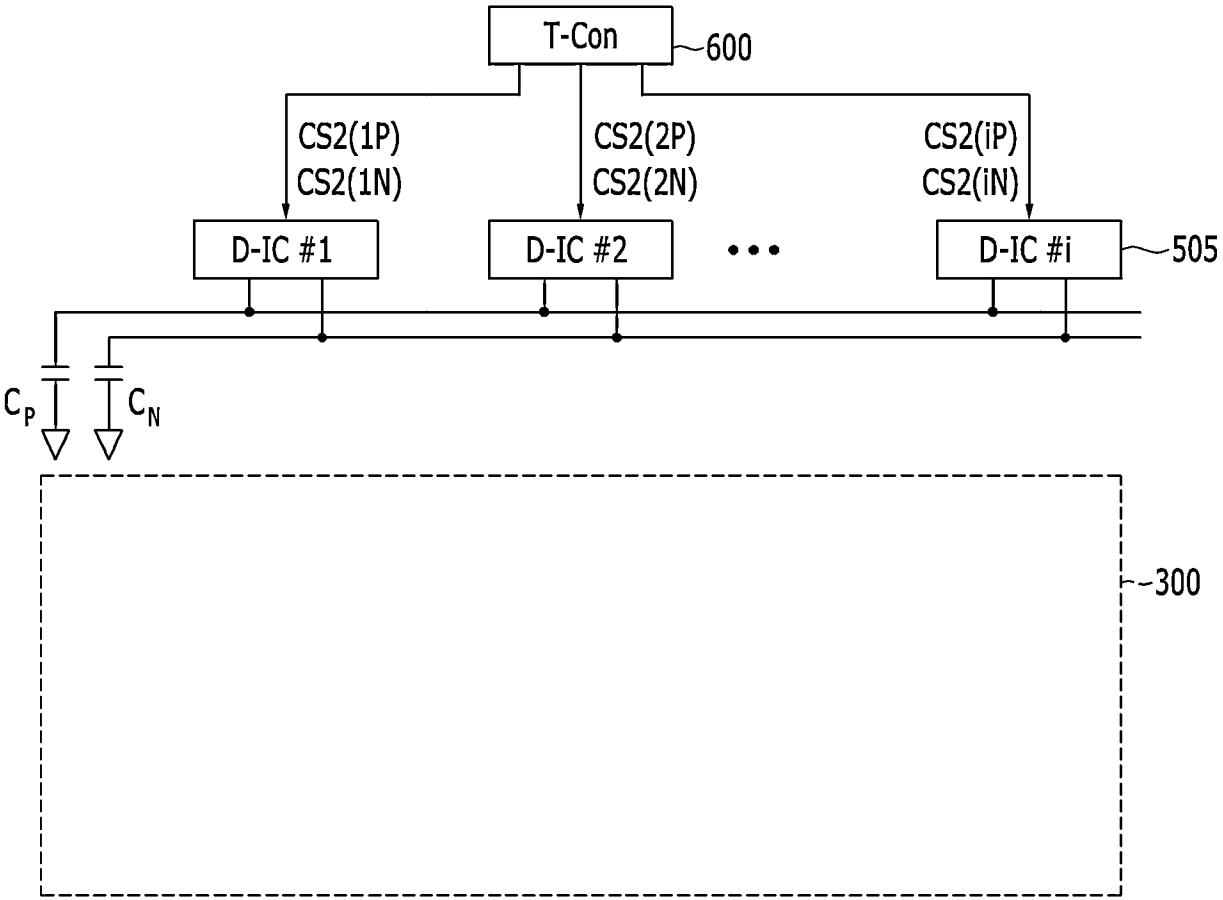
Figure 19:
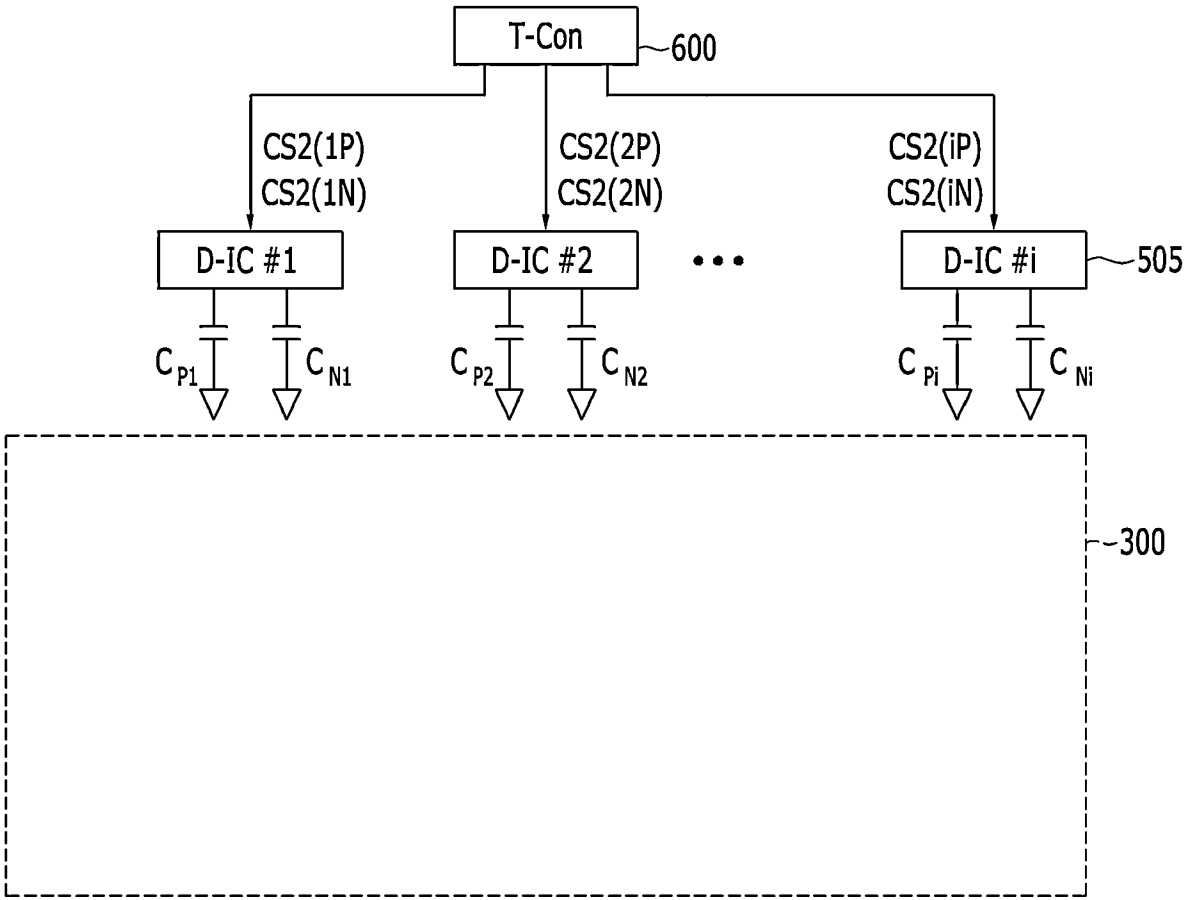

FIGS. 17 to 19 are block diagrams of a liquid crystal display according to an embodiment.

FIGS. 17 to 19 briefly illustrate only some constituent elements. In FIGS. 17 to 19, a plurality of independent ICs (e.g., data driving ICs) 505 configuring a liquid crystal panel 300, a signal controller 600, and a data driver 500 is illustrated.

First, the embodiment of FIG. 17 will be described.

In the embodiment of FIG. 17, the signal controller 600 and the plurality of data driving ICs 505 are connected as one unit. That is, since the signal controller 600 simultaneously controls the plurality of data driving ICs 505 by one signal, each of the data driving ICs 505 may not independently perform the second charge sharing. That is, the embodiment performs global second charge sharing.

For the global second charge sharing, additional capacitors Cp and Cn are formed one by one. In the embodiment, the additional capacitors Cp and Cn are positioned outside the data driving IC 505. The additional capacitors Cp and Cn may be positioned inside the data driver 500.

In the embodiment of FIG. 18, the signal controller 600 and the plurality of data driving ICs 505 are connected to respective independent wirings. That is, since the signal controller 600 may control the plurality of data driving ICs 505 by respective signals (e.g., CS2(1P), CS2(2P), . . . and CS2(iP)), each of the data driving ICs 505 may independently perform the second charge sharing. That is, the embodiment performs independent second charge sharing.

In the embodiment of FIG. 18, for the independent second charge sharing, additional capacitors Cp and Cn are formed one by one. That is, the data line independently performing the second charge sharing is connected to one of the additional capacitors Cp and Cn, and in this case, the sizes of the additional capacitors Cp and Cn may be predetermined. Further, in the embodiment, the additional capacitors Cp and Cn are positioned outside the data driving IC 505. The additional capacitors Cp and Cn may be positioned inside the data driver 500.

In the embodiment of FIG. 19, the signal controller 600 and the plurality of data driving ICs 505 are connected to respective independent wirings. That is, since the signal controller 600 may control the plurality of data driving ICs 505 by respective signals, each of the data driving ICs 505 may independently perform the second charge sharing. That is, the embodiment performs independent second charge sharing.

Meanwhile, in the embodiment of FIG. 19, unlike the embodiment of FIG. 18, additional capacitors Cpi and Cni are formed for each data driving IC 505, respectively. That is, the data line performing the second charge sharing for each data driving IC 505 is connected to each of the additional capacitors Cpi and Cni to perform the second charge sharing. As a result, the data line does not perform the second charge sharing with the adjacent data driving IC 505. In the embodiment, the additional capacitors Cpi and Cni are positioned outside the data driving IC 505, but according to an embodiment, may be positioned inside the data driving IC 505.

While this invention has been described in connection with what is presently considered to be practical embodiments, it is to be understood that the present invention is not limited to the disclosed embodiments, but, on the contrary, is intended to cover various modifications and equivalent arrangements included within the spirit and scope of the appended claims.

What is claimed is:

1. A liquid crystal display, comprising:

a display panel comprising a plurality of pixels and a plurality of data lines connected to the plurality of pixels;

a signal controller configured to receive an input image signal and an input control signal and output an output image signal and an output control signal, the signal controller further configured to determine a charge sharing between two or more data lines having voltages in the same polarity; and a data driver configured to:

convert, based on the output control signal, the image signal into data voltages to be supplied to the plurality of data lines connected to the plurality of pixels, the data voltages having a plurality of positive levels and a plurality of negative levels;

perform a first charge sharing by short-circuiting first and second data lines that are adjacent to each other, the first data line having a positive voltage and the second data line having a negative voltage in a first time period immediately prior to the first charge sharing, and the first data line having a negative voltage and the second data line having a positive voltage in a second time period immediately subsequent to the first charge sharing;

perform a second charge sharing by short-circuiting third and fourth data lines having data voltages in the same polarity, the third data line having a first voltage level of the same polarity in a third time period immediately prior to the second charge sharing and a second voltage level of the same polarity in a fourth time period immediately subsequent to the second charge sharing; and determine for each data line whether the second charge sharing is to be performed and output a signal indicating that the second charge sharing is to be performed, only when a difference between a data voltage in a previous row of the plurality of pixels and a data voltage in a present row of the plurality of pixels among the data voltages applied to the corresponding data lines is greater than or equal to a threshold voltage, wherein the first charge sharing between the first and second data lines having opposite polarities and the second charge sharing between the third and fourth data lines having the same polarity do not temporally overlap with each other.

2. The liquid crystal display of claim 1, wherein:

the pixels adjacent in an extending direction of the data lines among the plurality of pixels are connected to the adjacent data lines having different polarities.

3. The liquid crystal display of claim 2, wherein:

the output control signal includes an inversion signal for inverting the polarities of the data voltages for each frame, each frame comprising a plurality of sub-periods, and the first charge sharing is performed during the first sub-period after the polarities of the data voltages are inverted by the inversion signal.

4. The liquid crystal display of claim 3, wherein:

during the second charge sharing, the data driver connects together the data lines representing the same polarity and an additional capacitor.

5. The liquid crystal display of claim 4, wherein:

the second charge sharing comprises a positive charge sharing stage in which the data lines to which positive data voltages are applied are short-circuited, and a negative charge sharing stage in which the data lines to which negative data voltages are applied are short-circuited, and the positive and negative charge sharing stages are either simultaneously performed or do not temporally overlap with each other.

6. The liquid crystal display of claim 5, wherein:

the signal controller comprises a charge sharing determining unit configured to determine whether the second charge sharing is to be performed, and the data driver comprises:

a charge sharing controller configured to output a charge sharing control signal for controlling the first charge sharing and the second charge sharing; and a charge sharing operation unit configured to operate according to the charge sharing control signal output by the charge sharing controller.

7. The liquid crystal display of claim 6, wherein:

the charge sharing operation unit of the data driver comprises a first charge sharing operation unit configured to perform the first charge sharing and a second charge sharing operation unit configured to perform the second charge sharing, and image data transferred from the signal controller to the data driver is output to the data lines sequentially through:

a first MUX configured to select a path for converting the image data to a data voltage of a suitable polarity;

a DAC configured to convert the image data into the data voltage of the suitable polarity;

the second charge sharing operation unit configured to perform the second charge sharing;

a second MUX configured to select a path to the data line to which the data voltage is to be applied; and a first charge sharing operation unit configured to perform the first charge sharing.

8. The liquid crystal display of claim 6, wherein:

image data transferred from the signal controller to the data driver is output to the data lines sequentially through:

a first MUX configured to select a path for converting the image data to a data voltage of a suitable polarity;

a DAC configured to convert the image data into the data voltage of the suitable polarity;

a second MUX configured to select a path to the data line to which the data voltage is to be applied; and the charge sharing operation unit configured to perform the first charge sharing and the second charge sharing.

9. The liquid crystal display of claim 6, wherein:

the charge sharing operation unit of the data driver comprises a first charge sharing operation unit configured to perform the first charge sharing, a second charge sharing operation unit configured to perform the second charge sharing, and an independent charge sharing operation unit configured to determine for each data line whether the second charge sharing is to be performed and to output a signal indicating whether the second charge sharing is to be performed, and image data transferred from the signal controller to the data driver is output to the data lines sequentially through:

a first MUX configured to select a path for converting the image signal to a data voltage of a suitable polarity;

a DAC configured to convert the image data into the data voltage of the suitable polarity;

the second charge sharing operation unit configured to perform the second charge sharing based on the signal output by the independent charge sharing operation unit;

a second MUX configured to select a path to the data line to which the data voltage is to be applied; and a first charge sharing operation unit configured to perform the first charge sharing.

10. The liquid crystal display of claim 9, wherein:

the independent charge sharing operation unit outputs a signal indicating that the second charge sharing is to be performed, only when the MSB of the image data applied to a previous sub-period and the MSB of the image data applied to a subsequent sub-period are different from each other.

11. The liquid crystal display of claim 6, wherein:

the charge sharing operation unit of the data driver comprises a first charge sharing operation unit configured to perform the first charge sharing, a second charge sharing operation unit configured to perform the second charge sharing, and an independent charge sharing operation unit configured to determine for each data line whether the second charge sharing is to be performed and to output a signal indicating whether the second charge sharing is to be performed, and image data transferred from the signal controller to the data driver is output to the data lines sequentially through:

a first MUX configured to select a path for converting the image data to a data voltage of a suitable polarity;

a DAC configured to convert the image data into the data voltage of the suitable polarity;

a second MUX configured to select a path to the data line to which the data voltage is to be applied;

a first charge sharing operation unit configured to perform the first charge sharing; and a second charge sharing operation unit configured to perform the second charge sharing based on the signal output by the independent charge sharing operation unit.

12. The liquid crystal display of claim 11, wherein:

the independent charge sharing operation unit outputs a signal indicating that the second charge sharing is to be performed, only when a difference between a data voltage in a previous row of the plurality of pixels and a data voltage in a present row of the plurality of pixels among the data voltages applied to the corresponding data lines is greater than or equal to a threshold voltage.

13. The liquid crystal display of claim 11, wherein:

the independent charge sharing operation unit outputs a signal indicating that the second charge sharing is to be performed, only when the MSB of the image data applied to a previous sub-period and the MSB of the image data applied to a subsequent sub-period are different from each other.

14. The liquid crystal display of claim 6, wherein:

the data driver further comprises a second charge sharing determining unit configured to determine whether the second charge sharing is to be performed and to output a signal indicating whether the second charge sharing is to be performed, and the signal output by the second charge sharing determining unit is input to the charge sharing controller to operate the charge sharing operation unit.

15. The liquid crystal display of claim 14, wherein:

the second charge sharing determining unit comprises:

a charge sharing latch configured to store input image data;

an XOR unit configured to perform an XOR operation on the MSB of the image data in the current sub-period and the MSB of the image data in the sub-period immediately preceding the current sub-period stored in the charge sharing latch;

an OR unit configured to perform an OR operation on the output of the XOR unit and a signal indicating whether the second charge sharing is to be performed in all the data lines or to be performed selectively; and an AND unit configured to perform an AND operation on the output of the OR unit and a signal indicating whether the second charge sharing is to be performed.

16. A driving method of a liquid crystal display comprising:

a display panel comprising a plurality of pixels and a plurality of data lines connected to the plurality of pixels; a signal controller configured to receive an input image signal and an input control signal and output an image signal and an output control signal, the signal controller further configured to determine a charge sharing between two or more data lines having voltages ion the same polarity; and a data driver configured to convert, based on the output control signal, the image signal into data voltages to be supplied to the plurality of pixels through the data lines, the driving method, comprising:

performing a first charge sharing by short-circuiting first and second data lines that are adjacent to each other, the first data line having a positive voltage and the second data line having a negative voltage in a first time period immediately prior to the short-circuiting of the first and second data lines, and the first data line having a negative voltage and the second data line having a positive voltage in a second time period immediately subsequent to the short-circuiting of the first and second data lines; and performing a second charge sharing by short-circuiting third and fourth data lines having data voltages in the same polarity, only when a difference between a data voltage in a previous row of the plurality of pixels and a data voltage in a present row of the plurality of pixels among the data voltages applied to the corresponding data lines is greater than or equal to a threshold voltage, the third data line having a first voltage level of the same polarity in a third time period immediately prior to the short-circuiting of the third and fourth data lines and a third voltage level of the same polarity in a fourth time period immediately subsequent to the short-circuiting of the third and fourth data lines, wherein the short-circuiting of the first and second data lines having opposite polarities and the short-circuiting of the third and fourth data lines having the same polarity do not temporally overlap with each other.

17. The driving method of a liquid crystal display of claim 16, further comprising:

transferring, by the signal controller, an inversion signal to the data driver for inverting the polarities of the data voltages for each frame, each frame comprising a plurality of sub-periods, wherein the short-circuiting of the first and second data lines is performed during the first sub-period after the polarities of the data voltages are inverted by the inversion signal.

18. The driving method of a liquid crystal display of claim 17, further comprising:

connecting together the data lines representing the same polarity and an additional capacitor in the short-circuiting of the third and fourth data lines.

19. The driving method of a liquid crystal display of claim 18, further comprising:

short-circuiting the data lines to which positive data voltages are applied in a positive charge sharing stage of the short-circuiting of the third and fourth data lines; and short-circuiting the data lines to which negative data voltages are applied in a negative charge sharing stage of the short-circuiting of the third and fourth data lines, wherein the positive charge sharing stage and the negative charge sharing stage are either simultaneously performed or do not temporally overlap with each other.

* * * * *